US005258191A

United States Patent [19]

Hayes

[11] Patent Number: 5,258,191

[45] Date of Patent: Nov. 2, 1993

[54] VACUUM-SEALED FOOD CONTAINER HAVING PRESS-ON, PRY-OFF CLOSURE

[75] Inventor: Thomas H. Hayes, Lancaster, Ohio

[73] Assignee: Anchor Hocking Corporation, Lancaster, Ohio

[21] Appl. No.: 820,445

[22] Filed: Jan. 13, 1992

Related U.S. Application Data

[63] Continuation-in-part of Ser. No. 819,462, Jan. 10, 1992, which is a continuation-in-part of Ser. No. 694,903, May 2, 1991, abandoned, which is a continuation-in-part of Ser. No. 694,149, May 1, 1991, abandoned.

[51] Int. Cl.[5] ..... B65B 55/00; B65D 85/00

[52] U.S. Cl. ..... 426/107; 426/113; 426/401; 426/405; 426/407

[58] Field of Search ..... 426/106, 107, 113, 401, 426/404, 405, 406, 407

[56] References Cited

U.S. PATENT DOCUMENTS

| | | | |
|---|---|---|---|
| 2,517,542 | 8/1950 | Clifcorn et al. | 426/405 |
| 3,850,330 | 11/1974 | Koontz et al. | 215/262 |
| 3,913,771 | 10/1975 | Acton | 215/274 |
| 4,024,976 | 5/1977 | Acton | 215/256 |
| 4,362,253 | 12/1982 | Wortley et al. | 215/256 |
| 4,390,552 | 6/1983 | Niwa | 426/106 |
| 4,694,970 | 9/1987 | Hayes | 215/276 |
| 4,993,572 | 2/1991 | Ochs | 215/276 |

FOREIGN PATENT DOCUMENTS 0323812 7/1980 European Pat. Off. .

0366617 5/1990 European Pat. Off. .

OTHER PUBLICATIONS

Bakker et al, "The Wiley Encyclopedia Of Packaging Technology", published by John Wiley & Sons, 1986, pp. 370 and 371.

Lopez, "A Complete Course In Canning", published by the Canning Trade, 10th Edition, 1975, pp. 158–160.

*Primary Examiner*—George Yeung

*Attorney, Agent, or Firm*—Wood, Herron & Evans

[57] ABSTRACT

Easily removable press-on, pry-off closures having movable insert disks in an outer shell are disclosed. Pressing the shell upward to remove it from a container first pries a protrusion inside the shell over a snap rib around the container, then moves the shell upward relative to the disk while the later remains seated on the container, until a disk-lifting projection inside the shell engages the edge of the disk and lifts the disk to break the seal. A tamper evidencing band, if included, is broken before either the shell is pried off or the disk is lifted. The invention can be used in both top load and bottom load embodiments. Also disclosed is a closure with a non-movable disk or integral top and a tamper-evidencing band which is broken by pry-off removal of the closure. Still further, food packages which automatically open when heated in microwave ovens are disclosed. Vacuum-packed food packages having effective head spaces for reducing the times required to retort such packages are also disclosed.

25 Claims, 11 Drawing Sheets

VACUUM-SEALED FOOD CONTAINER HAVING PRESS-ON, PRY-OFF CLOSURE

RELATED APPLICATIONS

This is a continuation-in-part application of U.S. patent application Ser. No. 819,462, filed Jan. 10, 1992, which is a continuation-in-part application of Ser. No. 07/694,903, filed May 2, 1991, now abandoned, which is a continuation-in-part of U.S. patent application, Ser. No. 07/694,149, filed May 1, 1991, now abandoned.

FIELD OF THE INVENTION

This invention relates to a more easily removable closure of the type which is secured by pressing it downwardly over a snap rib on a container and which is removed by prying it off upwardly. This invention also relates to food packages which automatically open when heated in microwave ovens and vacuum-packed food packages equipped with effective head spaces for reducing the times required to retort such vacuum-packed food packages.

BACKGROUND

Jars and similar containers which are packed with a food product under vacuum (having less than atmospheric pressure in the head space above the food product) are more difficult to open than those which are not packed under vacuum. Atmospheric pressure above the closure exceeds the pressure in the head space beneath the closure, so that a net pressure differential force acts downwardly on the closure to hold it on the container. Since this pressure force is proportional to the area of the mouth of the container, it increases as the square of the radius of the container increases. Moreover, this pressure force rapidly increases as the size of the mouth of the container increases. Because the pressure force acts in conjunction with the frictional force of the closure threads, lugs, snaps, or other securing means to hold the closure on the container, it is much more difficult to remove a closure on a vacuum packed product. If the closure is a unitary, i.e., having an integral top panel screw thread closure, the mechanical friction between it and the container threads and the vacuum force must be overcome simultaneously. This occurs with these types of closures as the closures are rotated off the containers.

So-called composite closures, in which a separate insert disk or lid is rotatable within a threaded skirt or shell, facilitate opening vacuum packed containers because the shell can be rotated on the container to overcome the starting or mechanical friction without at the same time rotating the disk on the top or breaking the vacuum. Once the starting or mechanical friction is overcome, the threads gradually lift the disk and break the vacuum.

However, the problem is more difficult with closures of the so-called "press-on, pry-off" type, which are not removed by rotation. Such closures have a protrusion inside the shell which snaps beneath a snap rib on the container finish to secure the closure. Since no threads or lugs provide a mechanical advantage to lift the insert disk, the closure must be removed by prying it upwardly, as with a thumb positioned on its lower edge or an outwardly projecting tab, so as to force the shell protrusion over the snap rib. Both the pressure differential force and the tension of the snap must also be simultaneously overcome by the upward lifting force. Indeed, the required lifting force is so great that press-on, pry-off closures are impractical for some vacuum packed product containers, especially if the container's mouth diameters are greater than about 72 mm., unless an outwardly extending thumb tab is provided to give the needed leverage.

The force required to press open a press-on, pry-off closure is greater still if a tamper evidencing band is present. Such bands are designed to break or tear away before the closure can be opened or the contents interfered with, and are widely used to provide a visible indication if the closure has been partially or fully opened. Breaking the band adds another resistance which must be overcome, and thus further increases the pry-open force required.

In addition to the above-mentioned problems associated with removing closures from vacuum-packed containers, there is the ever increasing problem of a "dirty finish" on the container outer necks and snap ribs resulting from faster container filling and capping speeds. In other words, as the container filling and capping speeds increase, the more likely it is that the contents, such as food products, with which the containers are to be filled, will spill or splash onto the outer necks and snap ribs of the containers.

This "dirty finish" is also a common occurrence with those containers that are subject to retorting, i.e., following container filling and capping, food or vacuum-packed containers are cooked to temperatures on the order of about 250° F. to sterilize the food contents filled therein. During the retorting process, if there is less than, for example, a 6% head space left in the containers due to overfill or if there is too much pressure within or too little pressure outside of the food or vacuum-packed containers, the hydraulic forces within the containers will cause the vacuum seals to break and the inner food contents to seep between the container rims and the closures and then onto the containers, outer necks and snap ribs.

In either situation, the "dirty finish" on the container necks and snap ribs presents a sanitation problem if the spilled, splashed or seeped materials are permitted to remain and dry thereon. For example, if certain food residues are left on the outer necks and ribs of the containers to dry, mold growth, entrapped moisture, infestation of fruit flies or the like can result. Thus, a "clean finish" on the outer necks and snap ribs of the containers is required in order to meet and pass the USDA's FSIS requirements.

Still further, due to environmental concerns, there is an ever increasing demand to recycle plastic and glass containers such as described above. There is also an ever increasing demand to provide containers such as those described above with tamper evidencing indicators to advise consumers in advance as to whether the containers have or have not been tampered with. This is generally accomplished by providing the closures for containers with tamper evidencing bands which break free from the closures upon removal of the closures from the containers to open the containers. Unfortunately, a drawback associated with tamper indicating bands available heretofore is that, once they have been broken free from the closures, they remain secured around the necks of the containers. This drawback presents a recycling problem concerning the used containers, and in particular used glass containers, since the tamper evidencing bands which are secured to the container necks must be first cut free and removed therefrom before the used containers can be recycled, reused if not recycled.

Microwave ovens have become widespread in recent years, and have provided a way to rapidly and conveniently cook many types of foods. Unfortunately, unfrozen, shelf-stable microwave packages or containers available heretofore have been inconvenient if not unsatisfactory. A typical unfrozen, shelf-stable microwave package currently available is a plastic laminate tub having a plastic snap-on, pry-off dust cover or lid. To prevent contamination and to improve shelf stability, the opening of the plastic tub is sealed with a metal lid. Prior to microwaving the food in the packages, however, the plastic dust covers or lids must be pryed-off and the metal lids carefully removed. If the metal lids are not removed prior to microwaving the packages, the packages can split or rupture during the microwaving process permitting the food to leak out therefrom. Once the metal lids have been removed, the plastic dust covers or lids are snapped back on and the packages are then ready for cooking in microwaves.

To vent pressure or steam that may build internally within such packages during the microwave cooking process, the plastic dust covers of such packages are generally formed with a few through-holes. When these types of microwave packages are cooked in residential wattage microwaves, i.e., a maximum of about 750 watts, the plastic dust covers normally will not blow off and will guard against food splatter. However, if they are used in industrial wattage microwaves, i.e., near about 1,000 watts or greater, the few holes in the dust covers are sometimes to be insufficient, and consequently, the plastic dust covers or lids will either blow off or be ineffective in preventing food splatter, or both.

As an alternative to the plastic tub microwavable packages, glass containers having twist or screw-on type covers have been proposed. A major disadvantage with these types of packages, however, is that if the covers are not loosened or entirely removed prior to cooking, they can become potentially even more explosive due to the increase in internal pressure and steam resulting from the cooking process. For instance, a large diameter twist cap will hold approximately 10–15 lbs. of internal pressure before it vents or the package bursts.

As part of the manufacturing and packaging operations, most vacuum-packed food packages including these plastic tub microwavable food packages are almost or completely filled, e.g., on the order of about 94% to 100% filled, with food product, sealed and then retorted to precook and sterilize the food product contained therein. The retort process basically requires that the vacuum-packed food containers be cooked at high temperatures for prolonged periods of time. In other words, to ensure that the entire contents are properly precooked and sterilized, the outer portion of the contents are somewhat overcooked during the retort process. Unfortunately, the retort process, as presently performed, requires significant amounts of energy and labor costs. More importantly, however, the retort process conducted up to now substantially diminishes the quality of these vacuum-packaged food products from the standpoint of flavor, color and texture. Because of this shortcoming associated with the retort process, frozen foods are generally preferred over vacuum-packed, retorted, shelf-stable food products.

Up to now those skilled in the packaging arts have been unsuccessful in achieving an effective, long-term hermetic seal that are also resealable without compression at the sealant interface. Seals which are generally only achieved by tightly torqueing helic threads or lugs, or seal compression principally achieved by an internal package vacuum or both, or a crimped-on type closure seal that are typically non-resealable, etc. do not typically maintain an effective, long-term hermetic seal. The hand press-on, pry-off and resealable closures, which are less common than threaded or crimped-on package closures available heretofore, require an internal vacuum to effect and maintain a long term hermetic seal. However, as a vacuum is inappropriate with some food products, for instance, or is unachievable in most plastic containers, etc., the press-on closure seals are not considered a viable solution to forming and maintaining an effective long-term hermetic seal. As an alternative, seals formed with an adhesive sealant (potentially with a residual tack for a more effective reseal) have not been suitable because they generally cannot be easily pried-off or be adequately resealed.

Consequently, there is a demand in the industry for press-on, pry-off closures which can be more easily removed from containers by consumers. In addition, there is a demand in the industry for capped closures which have "clean finishes" on their outer necks and snap ridges following the filling and capping procedures as well as the retorting process. Still further, there is a demand in the industry for closures which facilitate the removal of the tamper indicating bands from used containers to simplify the use, reuse and recycling process of the used containers.

SUMMARY OF THE INVENTION

In accordance with one aspect of this invention a press-on, pry-off composite closure is provided which, among other uses, is effective for use on vacuum packed containers, even those having mouths larger than 72 mm in diameter. It is designed so that the various forces which resist opening—the force required to break a tamper evidencing band if present, the force required to overcome the tension in the snap, and the force required to break the vacuum and/or adhesive seal which holds the lid on the container—are overcome in separate, sequential stages, thereby reducing the force to a more handable magnitude. A tamper-evident band, if present, is broken first, by rupturing it progressively along its circumference; then the closure snap is progressively pried over the container snap rib, first at a narrow peripheral area and then around the rest of its circumference, and finally the insert disk is lifted off progressively around its circumference.

This result is achieved by the provision of "lost motion" between 1) the axial position at which the tamper-evidencing means is broken;
2) the position at which the closure shell is first pried over the snap rib of the container; and
3) the position at which the disk is engaged from beneath by the shell to lift it and break the seal, and by the provision of a shell which is elastically deformable so that it can be progressively pried off around its circumference, by a lifting force applied to it at a narrow circumferential position. The sequential release of the tamper evidencing means, the snap, and the insert disk preferably each proceeds from an initial point gradually around the periphery of the shell. By concentration of force at a narrow area, a much greater pressure can be applied to deform the shell than would be required if the entire circumference was disengaged all at once.

The invention can be used in either a "top load" closures, in which the insert disk is fitted into the shell by pressing it downwardly through the top opening from above, or it can be used in a "bottom load" closure in which the insert disk is pressed into the shell from below, past the locking projection. In both instances the disk is retained in the shell by a lip above at least a portion of it, and a lifting projection below it.

Since the closure is pressed into place on the container with a downward axial force, it can be assembled at a production facility much more quickly than a screw-on type closure, which requires rotation.

As a further advantage associated with the press-on, pry-off closures of the instant invention, it is possible to utilize a common sealant that is suitable for the majority of purposes for which the containers sealed with such closures will be use since there is no torquing required to seal such containers to the closures. This provides a real advantage over lug or screw-type closures since the torque requirements therewith vary between different food packaging processes thereby requiring that different sealants be used with the lug or screw-type closures. As a further advantage over the lug or screw-type closures, the press-on, pry-off closures and containers of the instant invention can be made smaller and with lighter material since screw threads and lugs are no longer required. To this end, the closures and containers of the instant invention provide a substantial economic advantage in materials, shipping and storing.

In another aspect of the invention, a unitary (non-composite) press-on, pry-off closure for a narrow neck container is provided. The closure has a deformable shell with an integral top and a tamper-evidencing band. The band is broken first, and the closure is then removed applying prying force at a narrow circumferential area. The skirt moves upwardly deforms upwardly in that area to which force is applied, so that the frangible bridges are broken first adjacent that area, while the remainder of the bridges remain intact. Continued prying movement causes the bridges to fracture proceeding in opposite directions around the circumference from the point of initial fracture. Continued application of prying force thereon lifts the closure over the snap rib. This embodiment is especially suitable for narrow neck containers in which the cross-sectional surface area of the closure is small, so that any pressure force on the seal can be broken at the same time the closure is lifted over the snap rib, without sequencing the breaking of the seal from the prying off of the closure.

In accordance with another aspect of the present invention, a press-on, pry-off closure is provided which has the ability to wipe or squeegee clean the outer neck and areas adjacent the snap rib or crest on the neck of a container during the capping process. Generally speaking, this can be accomplished by providing a shell of a closure such as a composite closure with a tamper evidencing band and a snap bead, and a container which has an inclined exterior surface which extends between the sealing rim and the snap bead on the neck of the container, so that the tamper evidencing band and/or shell snap bead wipes or squeegees the inclined exterior surface clean during the capping process. The tamper indicating band may be of any shape and formed of any material so long as it is effective in wiping or squeegeeing the inclined surface clean when the closure is pressed on the container during the capping process.

The snap bead on the shell of the closure may likewise be of any shape and formed of any material to provide a secondary wiping or squeegee action, or in the event that the closure is formed without a tamper indicating band, the primary wiping or squeegee action. The snap bead on the shell of the closure may therefore be formed of, for example, a cold flow thermoplastic, such as polypropylene, which will flex and squeegee during the capping process, but once stressed following capping, it will take on the permanent snap bead deformation thereby holding the closure on the container. Of course, the downward and outward inclined exterior surface of the container should be of such a size and inclination to permit the tamper indicating band and/or snap bead of the shell to wipe or squeegee its surface clean during the capping process.

In still another aspect of the instant invention, a closure is provided with tamper indicating means such as a band which can be uniquely removed from the container in connection with the removal of the closure from the container. More particularly, the tamper indicating band is provided with, for example, a vertical line of weakness which breaks upon removing the closure from the container. Once the vertical line of weakness is broken thereby opening the tamper indicating band and the tamper indicating band is freed from the closure, the consumer can easily remove the left-behind tamper indicating band from the container. As an alternative, a hinge permanently connecting the tamper indicating band to the shell of the closure can be positioned approximately 180° from the vertical line of weakness so that upon removal of the closure from the container, the tamper indicating band is also removed therefrom with the closure. It should be understood that as an alternative to the vertical line of weakness, the tamper indicating band may be discontinuous. That is, the tamper evidencing band may be formed with two ends which meet but remain disconnected. To assist in the removal of such a closure from the container, the shell may be equipped with a thumb tab positioned above the vertical line of weakness or where the tamper evidencing band is discontinuous. In those instances where it is desirable to reseal the opened container, the tamper evidencing band may be provided with such a hinge but without the vertical line of weakness or vertical interruption so that the closure remains connected to the tamper indicating band which is secured to the neck of the container for permitting the closure to be used to repeatedly open and close the container.

In still another feature of the instant invention, there is provided a press-on, pry-off composite closure with a valve system to substantially prevent the introduction of contaminants into a vacuum-packed container upon initially removing the closure from the vacuum-packed container. Generally speaking, the composite closure is provided with a gutter system formed by the disk and the shell of the composite closure to substantially catch contaminants which may be sucked into the container, which originate and travel over the external portion of the disk and from above the composite closure.

If desired, a second valve system may be employed with those containers described above wherein the necks of the containers are provided with downward and outward inclined exterior surfaces between their sealing rims and snap beads. In this embodiment, the snap beads of the shells of the composite closures are designed to uniquely remain in contact with the inclined exterior surfaces of the containers for a distance once they are slipped over the snap beads of the containers during the removal of the closures from the containers. During this time frame, the closure snap beads uniquely act to substantially block and prevent contaminants from entering the containers upon initially opening same, which may originate and travel along the lower neck portions of the containers and from underneath the closures. It should be understood that these valve systems may be used individually or in combination, and may be formed with top or bottom load press-on, pry-off composite closures. Of course, the second valve system may be employed with a unitary closure.

In yet another feature of the instant invention, there is provided a novel container uniquely designed with a multifunctional snap bead on its neck for use in connection with press-on, pry-off closures. Generally speaking, the multifunctional snap bead surrounds the container neck to form a composite annular peripheral bead which includes an angulated rib having inclined surface which extends downwardly and outwardly from the sealing rim of the neck to an annular peripheral rib or crest, and either an inclined annular friction surface which extends downwardly and inwardly from the peripheral rib or crest and a band-breaking shoulder therebelow or a locking peripheral rib below the annular rib or crest and a band-breaking shoulder therebelow. In either embodiment, the downward and outward inclined surface of the angulated rib has been uniquely designed to cooperate with the tamper indicating band and the snap bead on the shell of the closure. More particularly, the downward and outward inclined surface of the angulated rib facilitates the slipping of the tamper indicating band and shell snap bead over the container neck and permits the tamper indicating band and in some instances the shell snap bead to wipe its surface clean while being slipped thereover. When the multifunctional snap bead is designed with the downward and inward inclined friction surface, this surface acts to hold the closure on the container by mechanical friction between the snap bead of the closure and this friction surface.

It should be appreciated by those of skill in the art that in one unique feature associated with this embodiment is that, if there is a sufficient pressure differential during the retorting process so that the external pressure and mechanical friction is insufficient to hold the closure on the container, the closure will slide up the downward and inward inclined friction surface and over the snap bead or crests of the neck until it pops off following the rupture of the vacuum seal. In other words, when the vacuum seal breaks during, for example, the retorting process due to a sufficient pressure differential, the closures and containers of the instant invention will automatically self destruct by virtue of the closures popping off due to the build up of internal pressure. This unique feature is believed to assist in eliminating the problem associated with "dirty surfaces", etc. developed during the retorting process with closures and containers available hitherto. On the other hand, when the multifunctional snap bead is designed with the locking peripheral rib, this functions to accept the snap bead of the shell of the closure to hold it therein once the snap bead on the shell has passed over the downward and outward inclined surface and the snap bead on the neck. In either embodiment, the band-breaking shoulder acts to break the tamper indicating band when removing the closure from the container.

Accordingly, it can now be appreciated by those versed in this art that the present invention provides a solution to the closure art that has sought to overcome the shortcomings associated with press-on, pry-off closures, "dirty finishes", etc. following the filling and capping procedures, and the recycleability of tamper indicating bands available hitherto.

In accordance with a further feature of the present invention, there are provided novel vacuum-packed packages containing food products uniquely having effective head spaces for significantly reducing the times required to retort such packages, as compared to similar packages vacuum-packed with little or no head spaces. It has now been discovered that, by providing unfrozen, shelf-stable, vacuum-packed packages containing food product with volumetric head spaces on the order of about 8–16% or more as defined between the closure and the food product contained within the container, the cooking times associated with the retort process can be dramatically reduced. As a result, the quality of vacuum-packed food products following the retort process is significantly improved from the standpoint of flavor, color and texture, and now surprisingly approaches that of frozen foods. Moreover, because the cooking times of the retort process can now be reduced, a substantial savings in labor and energy costs can be realized.

As a further feature associated with equipping food packages or unfrozen, shelf-stable vacuum-packed food packages of the instant invention with effective head spaces, such food packages are especially suited for cooking in industrial and residential microwaves. It has been discovered that, as a result of the increase in head space, a snap-on, pry-off closure to a food package of the instant invention will vent or be gently, as opposed to violently, pressured loose from the container as the steam and pressure accumulate during the microwave cooking process. In other words, it has been discovered that, by providing an increase in head space, steam and pressure will gradually build within the closed food packages as it cooks and ease the snap-on, pry-off closures loose. This feature affords the added advantage of permitting the snap-on, pry-off closures to remain loosely on the containers, so that they can guard against food splash, thereby preventing food product from erupting out of the containers during the microwave cooking process. It has been further discovered that, when the lengths of the closure skirts are extended, this will help the pryed or pressured, loose snap-on, pry-off closures of the present invention to remain loosely on the rims of the containers and to act as splash guards during the entire microwave cooking process.

In accordance with a further feature of the present invention, plastic rings of snap-on, pry-off composite closures formed of, for example, polypropylene are provided. In a preferred form, the novel plastic rings are constructed with extended inwardly extending partial covers which typically extend along the entire downwardly sloping walls and onto the depressed central stacking panels of the dust covers or lids. It has been found that when such novel plastic rings are heated in, for example, microwaves, the plastic rings uniquely relax so that the closures act as diaphragms, thereby permitting the vacuum seals (if present) to be more easily broken and the snap-on, pry-off closures to be gently pressured loose from the containers during the microwave cooking process. Moreover, the plastic rings in accordance with this embodiment uniquely permit steam and pressure to escape in a downward direction between the container rims and the plastic ring beads and also, if so desired, in an upward direction between the interior sides of the plastic rings and the exterior sides of the dust covers or lids inserted into the plastic rings.

Further, relatively rigid polypropylene, or copolymers of polypropylene, such as product 5B04Z, Huntsman Polypropylene Company, and product SB787, Himont, Inc., are believed to be suited to withstand the high heat rigors of the retort process without dislodgement or distortion and, uniquely, it's been discovered that if blended as a copolymer, it still will not be too brittle, such that it could break if refrigerated to seal and store unused contents.

In summary, the use of this unique about 8–16% or greater headspace in vacuum-packed retorted food packages, versus the typical 0–6% headspace utilized heretofore, allows the contents to tumble within the vacuum-packed package and thereby cook more evenly, and, remarkably, to do so in less time in a high energy retort. And, at the same time, this unique headspace allows the sealed package to automatically vent slowly and less violently in the typically short (about 90 seconds for a single serving entree), but intense microwave reheat, in accordance with the present invention.

The above features and advantages of the present invention will be better understood with reference to the FIGS. and Detailed Description. It will also be understood that the closures, containers and tamper indicating bands of this invention are exemplary only and are not to be regarded as limitations of the invention.

BRIEF DESCRIPTION OF THE FIGS.

The invention can be further described by reference to the accompanying FIGS., in which, FIG. 1 is a perspective view of a container having a press-on, snap-off composite closure in accordance with the invention;

FIG. 2 is an enlarged partial axial section taken on line 2—2 of FIG. 1 and shows a closure having a top load insert disk, in accordance with an embodiment of the invention;

FIGS. 2A, 2B, and 2C are a series of views similar to FIG. 2, showing sequential stages as the closure is removed;

Figure 2:
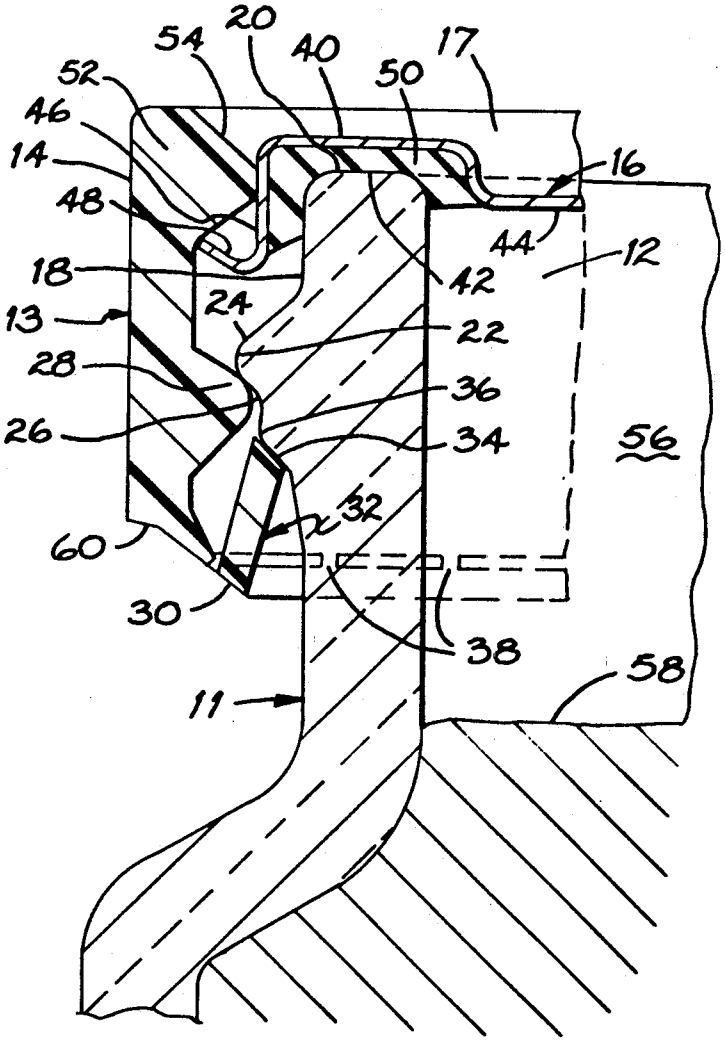
Figure 5:
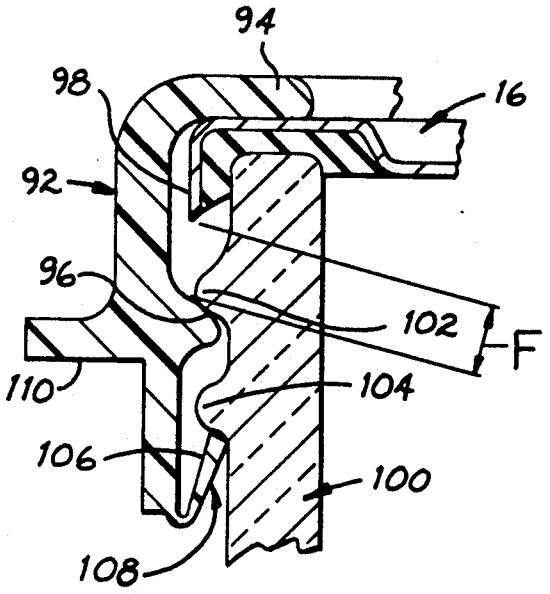
FIG. 5 is an axial section similar to FIG. 2, but shows another embodiment of the invention, having a bottom load closure.
Figure 6:
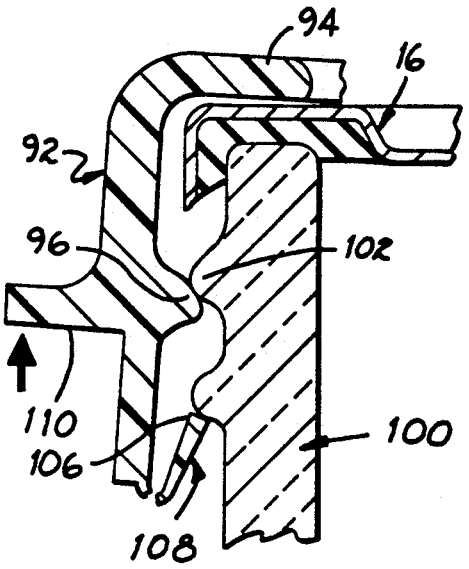
Figure 7:
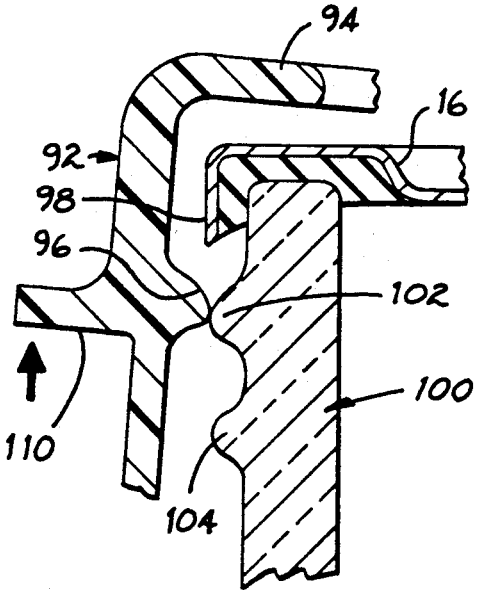
Figure 8:
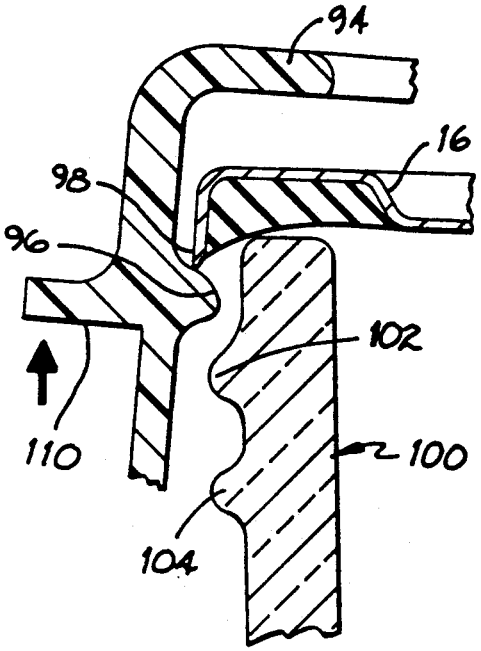
Figure 9:
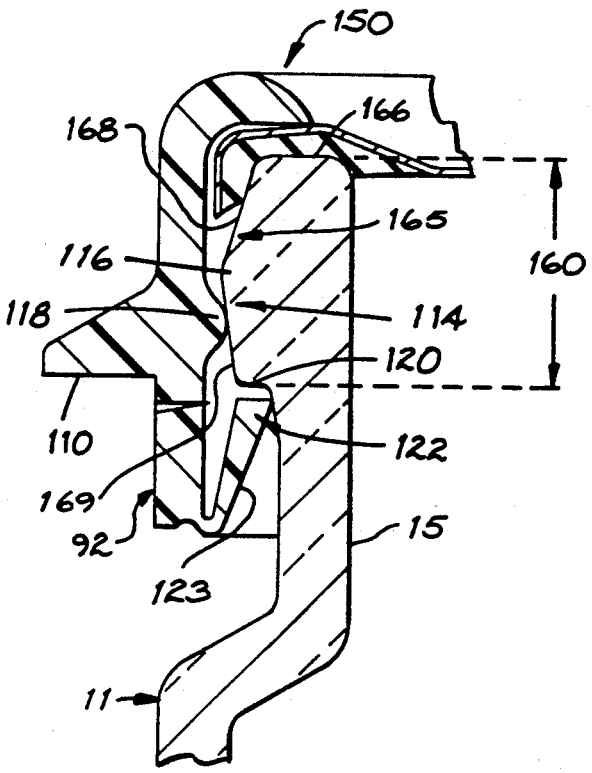
Figure 9A:
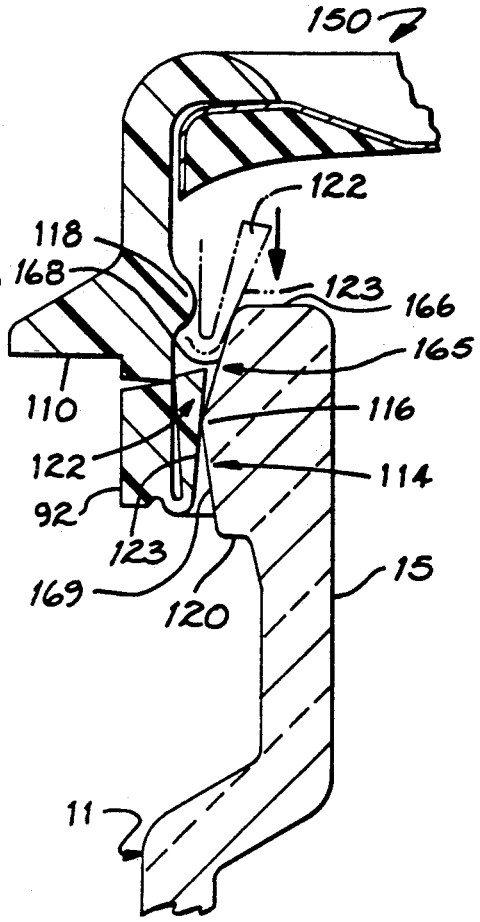
Figure 10:
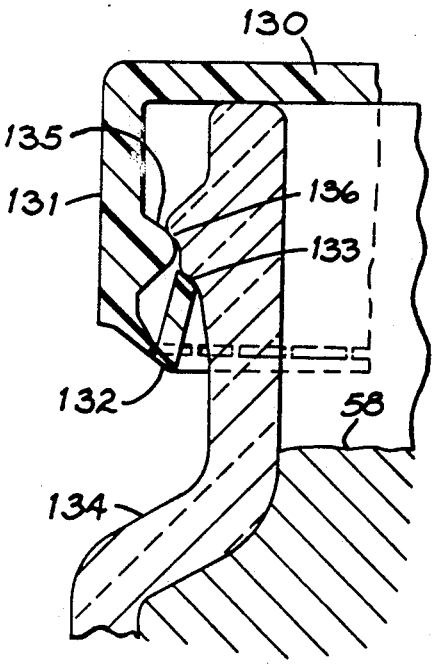
Figure 11:
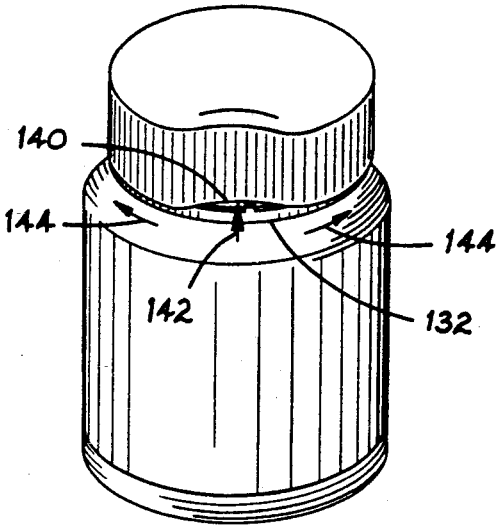
Figure 12:
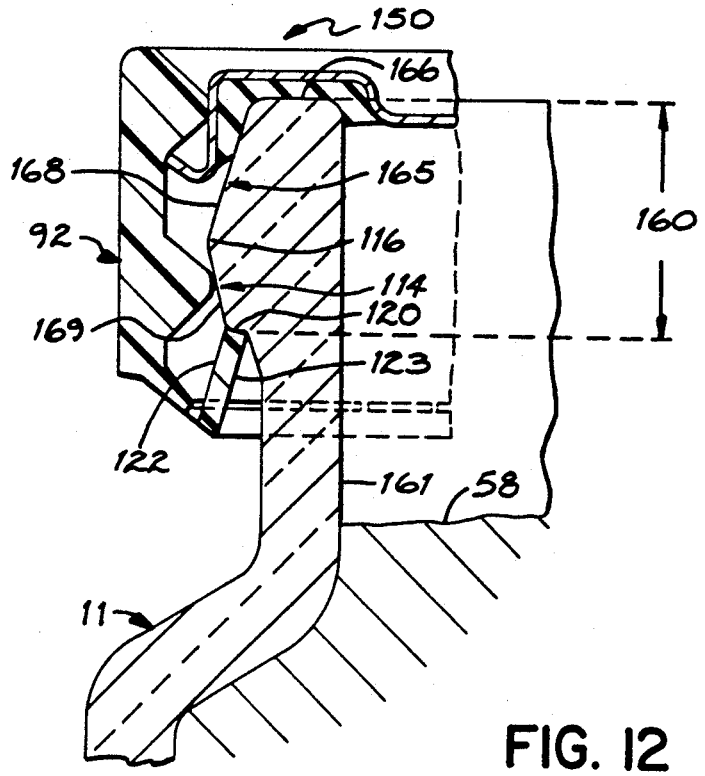
Figure 13:
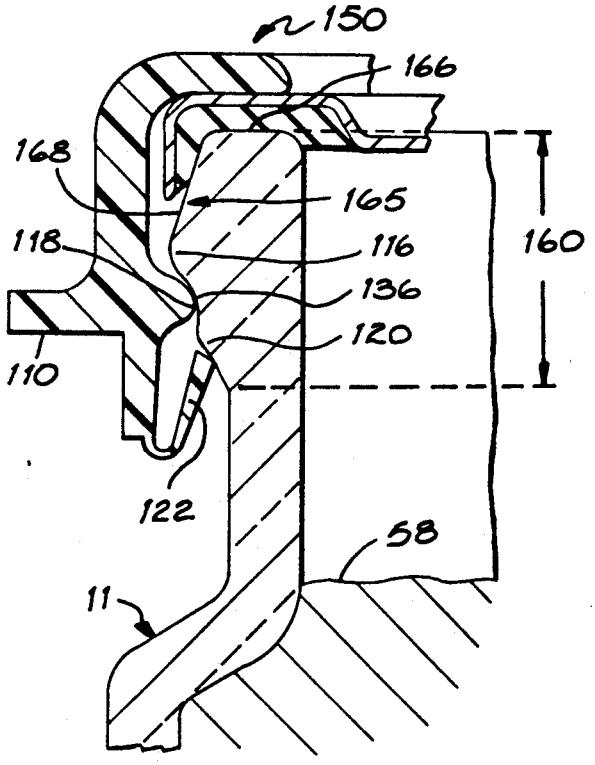
Figure 14:
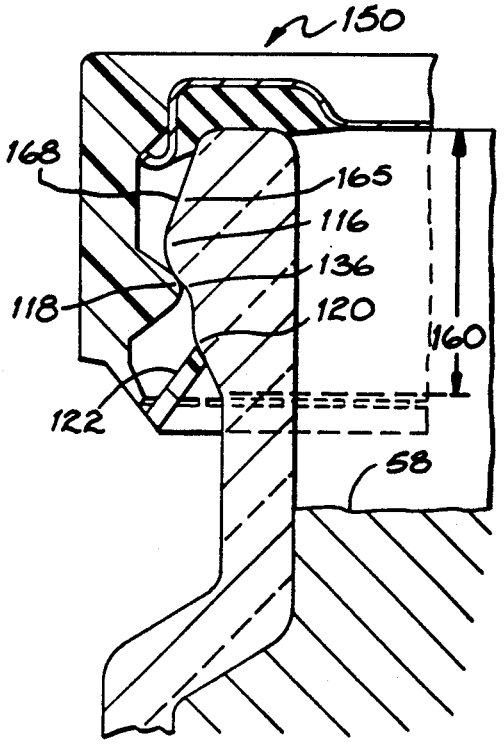
Figure 15:
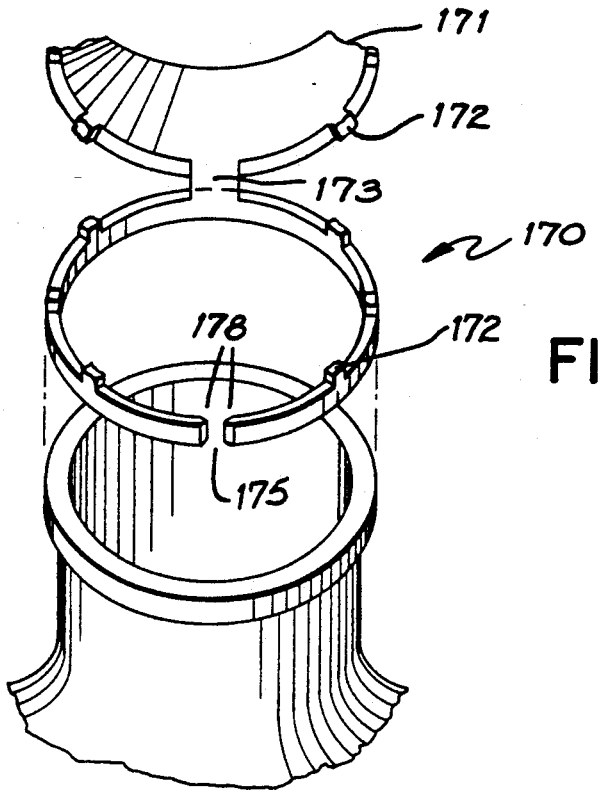
Figure 16:
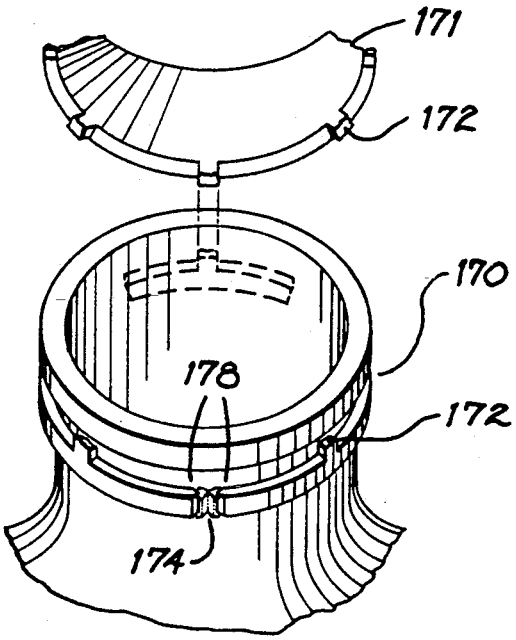
Figure 17:
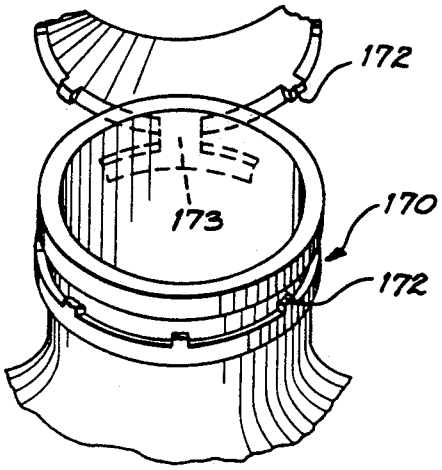
Figure 18:
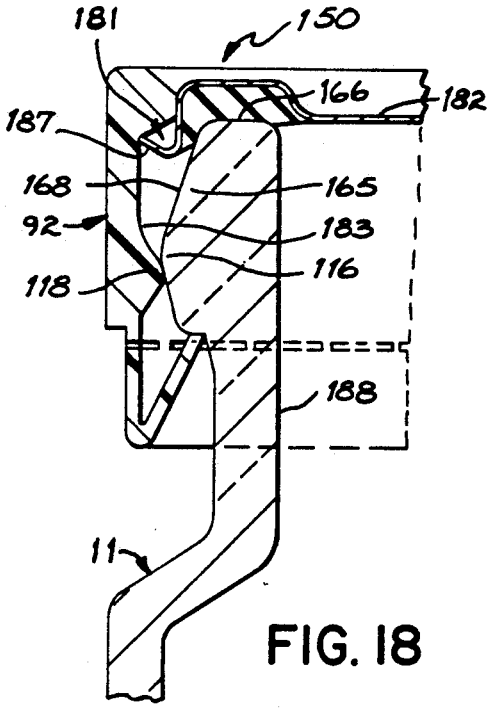
Figure 19:
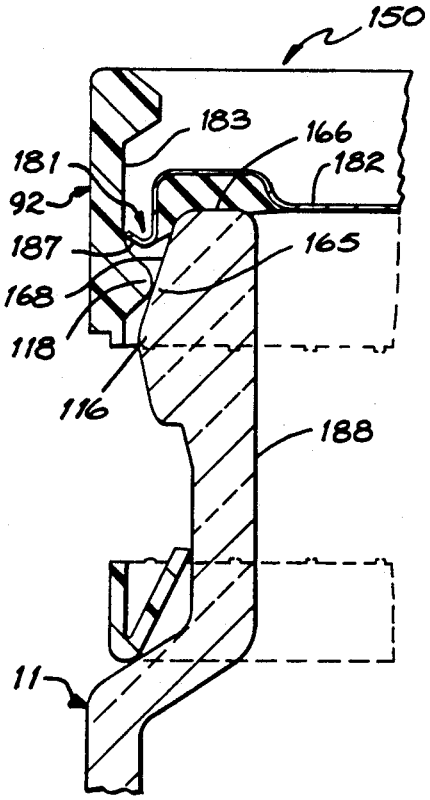
Figure 20:
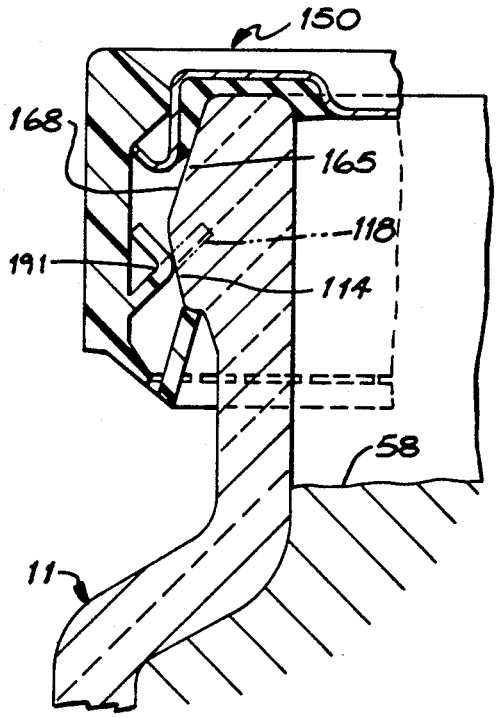
Figure 21:
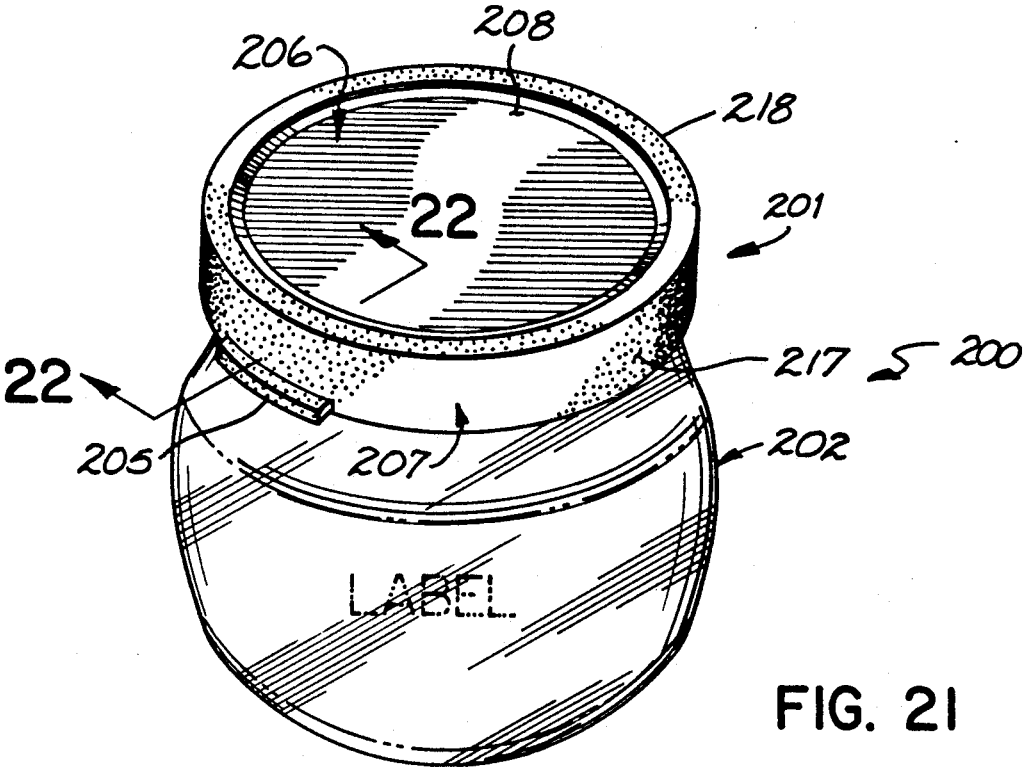
Figure 24:
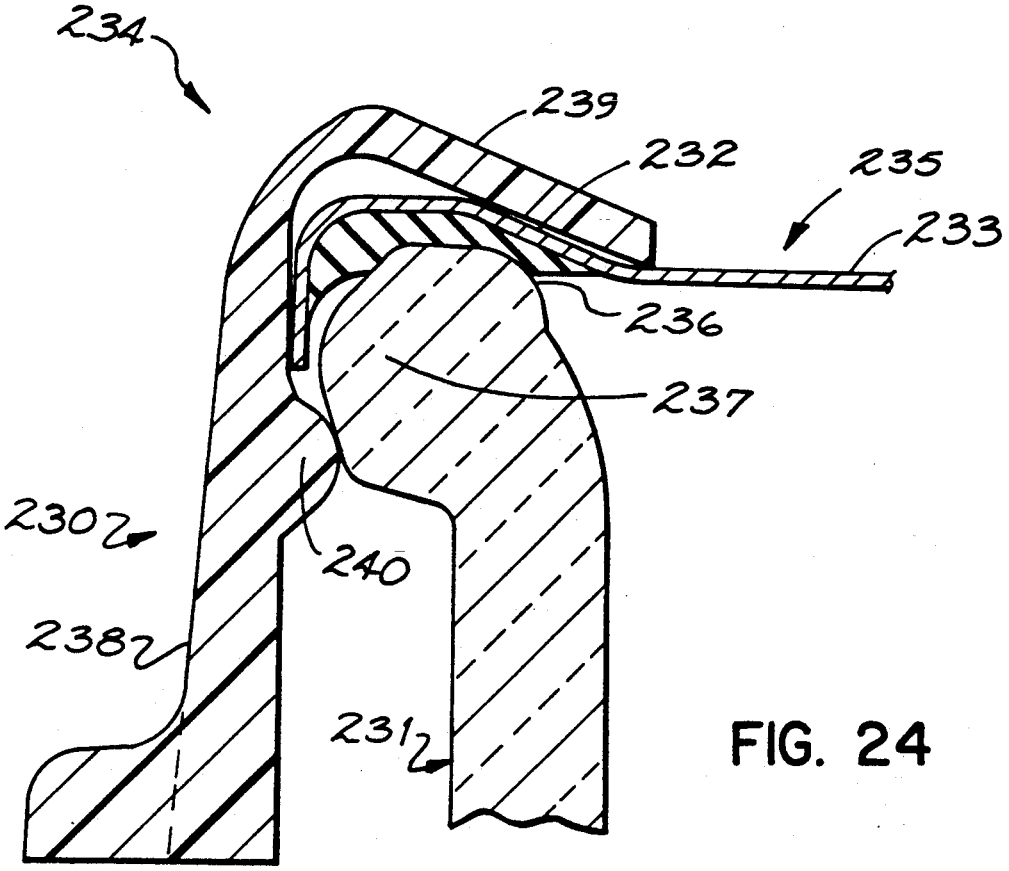
Figure 22:
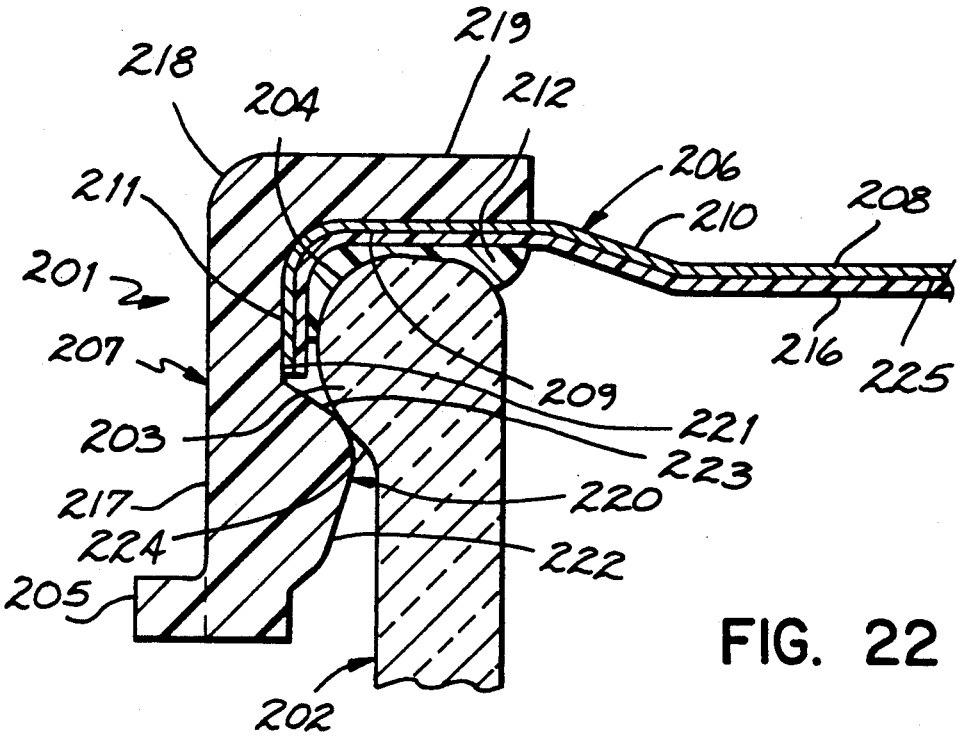
Figure 23:
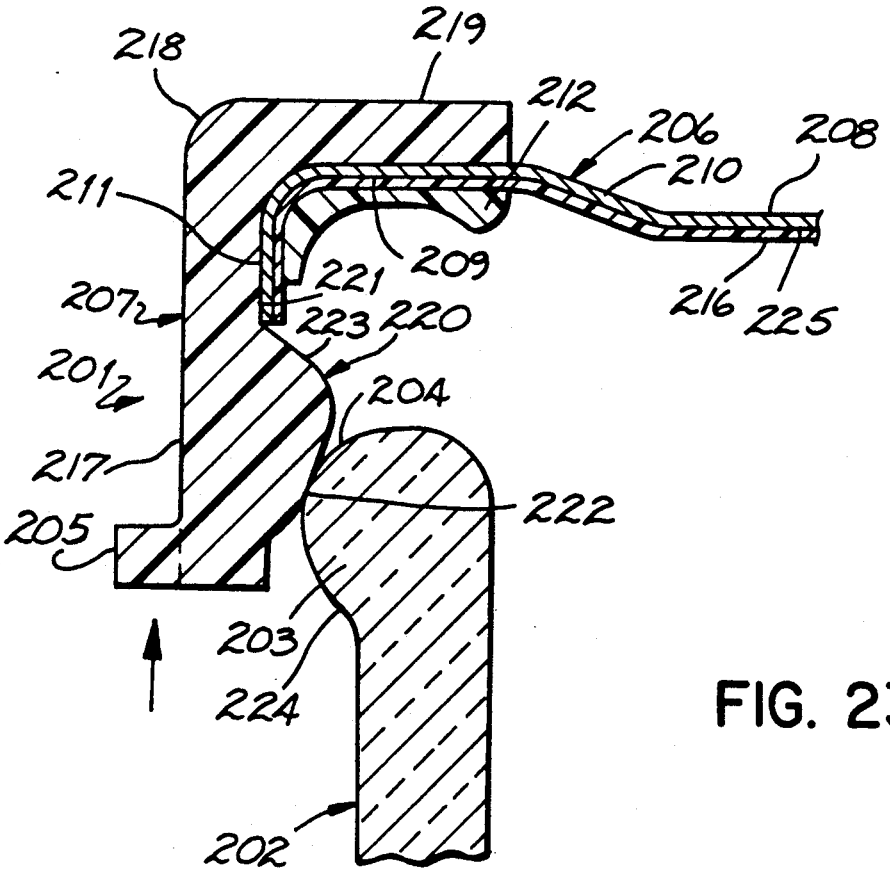
Figure 25:
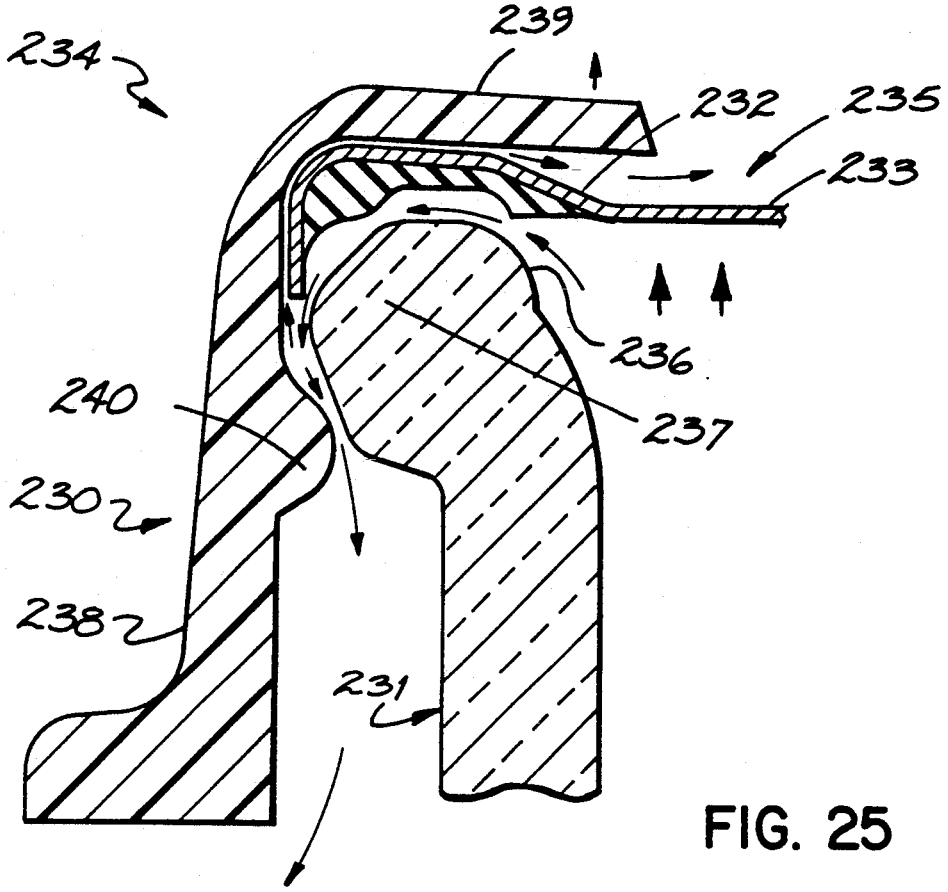
Figure 26:
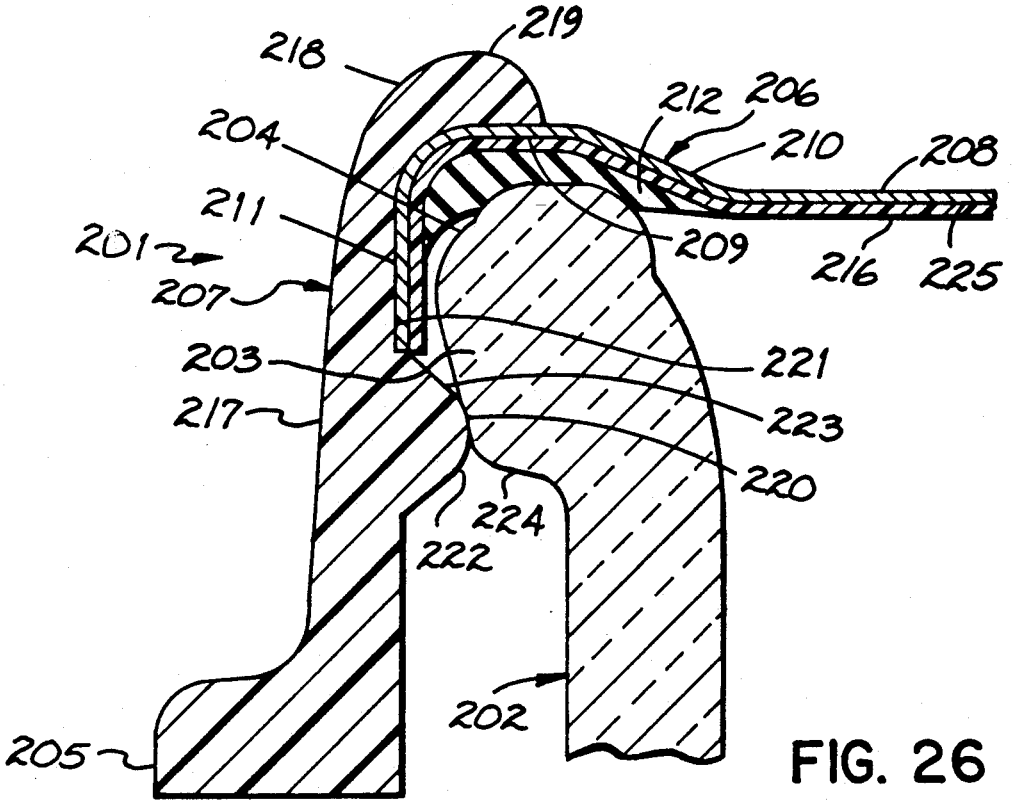

FIGS. 6, 7, and 8 are a series of axial sections similar to FIG. 5, but showing sequential steps as the bottom load closure is pressed upwardly to remove it from the container;

FIG. 9 is an axial view similar to FIG. 2, but showing a bottom load closure in another embodiment;

FIG. 9A is an axial view similar to FIG. 9, but showing the wiping or squeegeeing action of the tamper indicating band over the downward and outward incline surface and peripheral snap bead or crest of the container as the bottom load composite closure is positioned on the container;

FIG. 10 is a partial axial section of a unitary press-on, pry-off closure in accordance with another embodiment of the invention;

FIG. 11 is a front view of the closure of FIG. 10 showing how prying force deforms the shell to progressively break the tamper evidencing band around its circumference;

FIG. 12 is an axial view similar to FIG. 9, but showing a top load composite closure in another embodiment;

FIG. 13 is an axial view similar to FIGS. 2 and 9, but showing a bottom load composite closure in another embodiment;

FIG. 14 is an axial view similar to FIGS. 2 and 9, but showing a top load composite closure in another embodiment;

FIG. 15 is a perspective view of a partial container and partial closure showing a tamper indicating band hingedly connected to the closure and broken at a vertical line of weakness in accordance with the invention;

FIG. 16 is a perspective view of a partial container and partial closure showing a tamper indicating band broken free from the closure and at a vertical line of weakness in accordance with the invention;

FIG. 17 is a perspective view of a partial container and partial closure showing a tamper indicating band hingedly connected to the closure and secured around the neck of the container in accordance with the instant invention;

FIG. 18 is an axial view similar to FIGS. 2 and 9, but showing a top loaded composite closure and the valve systems in accordance with the invention;

FIG. 19 is an axial view similar to FIG. 18, showing a sequential stage during the removal of the closure from the container;

FIG. 20 is an axial view similar to FIGS. 2 and 9, but showing the wiping or squeegeeing position of a cold flow peripheral snap bead on a shell of a top load composite closure of the instant invention;

FIG. 21 is a perspective view of an alternative vacuum-packed food package sealed by a snap-on, pry-off closure in accordance with the present invention;

FIG. 22 is a vertical sectional view taken along line 22—22 on FIG. 21 when the package is in a sealed configuration;

FIG. 23 is a vertical sectional view similar to FIG. 22 except the package is in an unsealed configuration;

FIG. 24 is a vertical sectional view of an alternative snap-on, pry-off closure in a sealed configuration in accordance with the present invention;

FIG. 25 is a vertical sectional view of the alternative snap-on, pry-off closure illustrated in FIG. 24, but in an unsealed configuration; and FIG. 26 is a similar vertical sectional view taken along line 22—22 in FIG. 21 of an alternative package is in a sealed configuration.

DETAILED DESCRIPTION OF THE INVENTION

By way of providing a more complete appreciation of the present invention and many of the attendant advantages thereof, the following detailed description is provided concerning the novel press-on, pry-off closures, containers, and tamper indicating bands.

Figure 1:
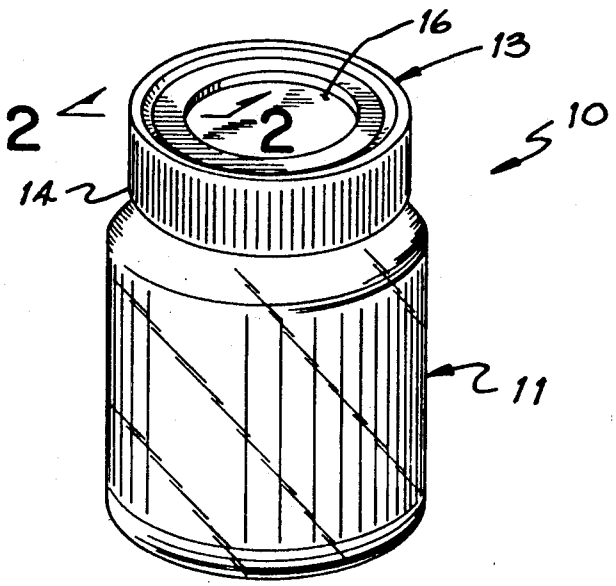

Referring now to FIGS. 1 and 2, package 10 comprises a wide mouth container 11 having a mouth 12 which may, for example, be 77 millimeters in diameter. As indicated above, the advantages of the instant invention increase rapidly with container size, and it is especially useful for vacuum packed containers of large diameter. However, it should be understood that the invention can be used in non-vacuum containers and on containers of smaller size. The closure 13 of package 10 is a top load composite closure having an annular plastic outer shell 14 and an insert lid or disk 16 contained within the shell, at the top thereof. Disk 16 is both axially and rotationally movable within the shell.

Figure 3:
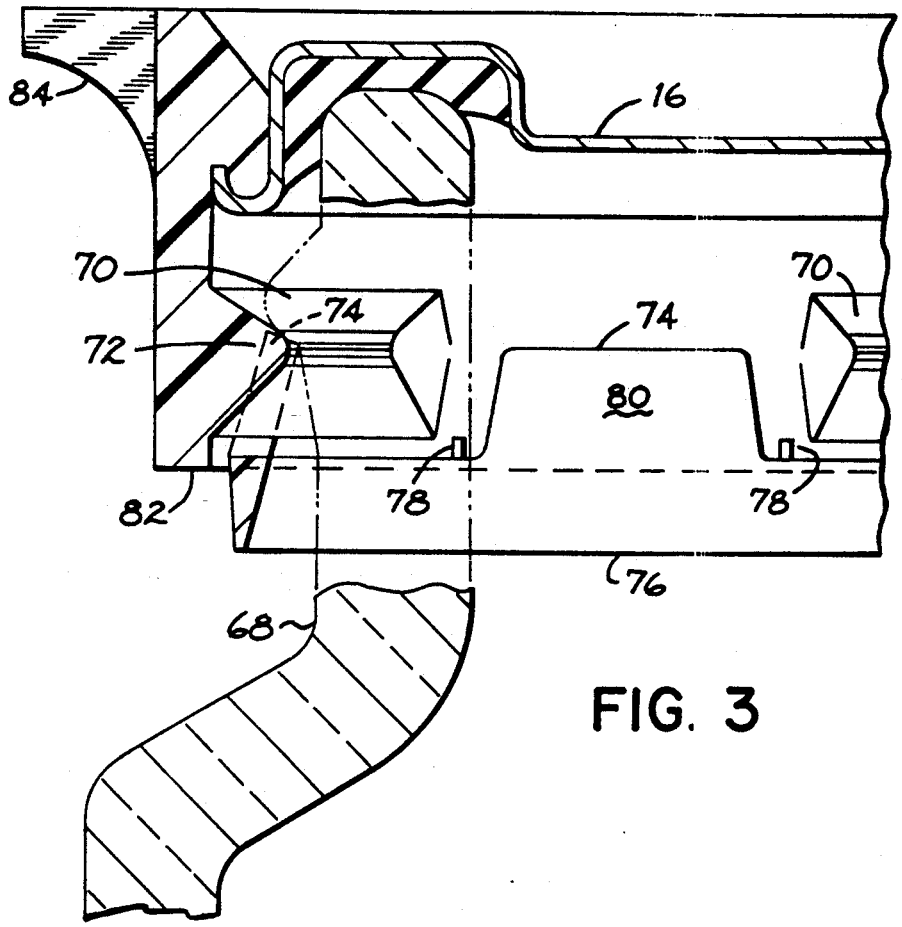
FIG. 3 is an axial section similar to FIG. 2, but shows another top load closure embodiment.
Figure 4:
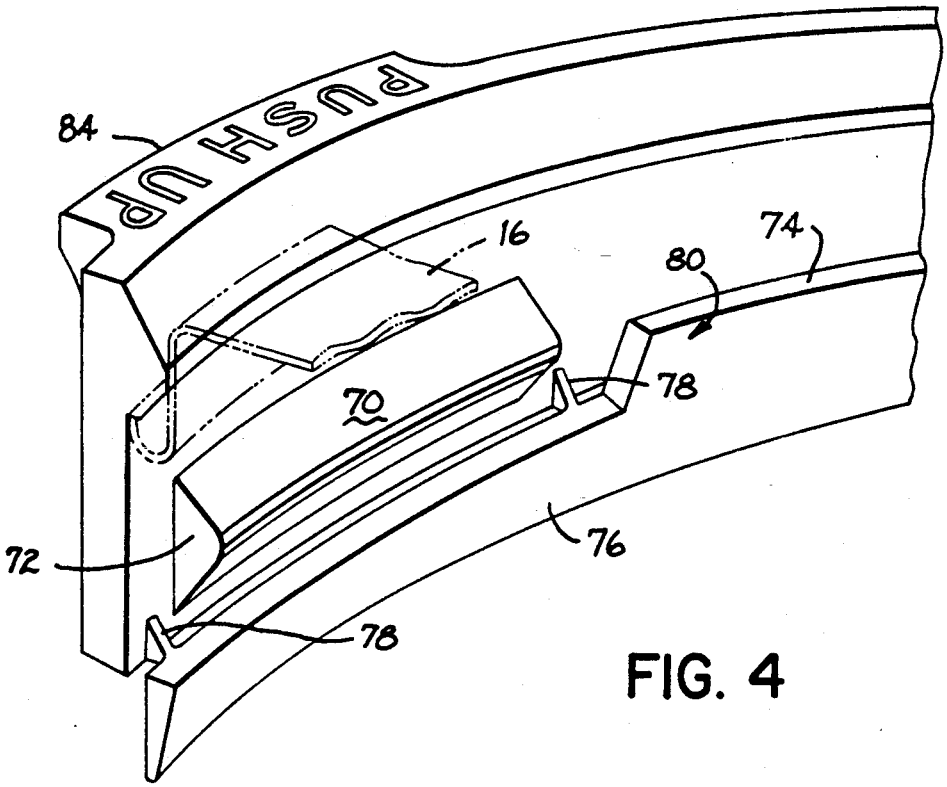
FIG. 4 is an enlarged perspective view, partly broken away, of the shell of the closure of FIG. 3.

FIGS. 2 and 3 illustrate two so-called "top load" embodiments of composite closures in accordance with the invention, in which insert disk 16 is pressed into a shell 14 downwardly through a top opening 17 in the shell 14. Referring now to FIG. 2 in more detail, container 11 has a finish portion 18 having a rounded sealing rim 20 at the top and, spaced below the rim, an annular peripheral rib 22 having a downwardly and outwardly sloping upper surface 24 and a downwardly and inwardly sloping lower surface 26. This rib 22, over which the closure snaps, engages an inwardly projecting snap or protrusion 28 in shell 14 to hold the closure 13 on the container 11. Protrusion 28 may be a continuous annular bead around the inside of the shell 14, or it can be spaced detents or ledges of relatively small angular extent. A continuous snap protrusion is preferred because a uniform circumferential hold down force is thereby applied to the sheet, which provides a better seal and prevents insect infestation.

In many applications, it is desirable to provide a tamper evidencing means which will break in some manner when the closure is opened, or started to be opened, to indicate that fact. In the embodiment of FIG. 2, tamper evidencing means 30 are provided in the form of an upwardly and inwardly extending fishhook or band 32 around the lower edge of the shell 14. When closure 13 is seated and sealed on the container 11, the inner or distal edge 34 of band 32 is positioned against or very close to a band-breaking shoulder 36 on the container 11. Band 32 is connected to shell 14 by a series of frangible bridges 38 shown in phantom which are designed to break when upward movement of the closure 13 presses the band against shoulder 36. In the FIG. 2 embodiment, shoulder 36 is positioned adjacent to and immediately below the lower surface 26 of snap rib 22, but in principle the two surfaces can be a single surface.

Insert disk 16 has an annular raised portion 40 which presents a downwardly opening channel 42, around a sunken center portion 44. Outwardly of raised portion 40, a downwardly extending peripheral sidewall 46 leads to an outwardly extending edge 48 to form a gutter which preferably is in contact with the inside wall of top lip 52 of shell 14. A sealant 50, which may be of known type, such as platisol, is contained in downwardly opening channel 42 and forms a seal with the sealing rim 20 of container 11. Insert disk 16 is movably captured in shell 14 by and between a top lip 52 of shell 14, and the snap protrusion 28 inside shell 14, with the disk outer edge 48 confined between lip 52 and protrusion 28. Because the disk can move relative to the shell, it is referred to as a floating disk. The upper surface of lip 54 is sloped or angulated so that the disk can be inserted below it by downward force, edge 48 camming and resilently expanding the top lip 54 so that disk 16 can snap beneath it to the position shown in FIG. 2. Insert disk 16 can be made of metal, cellulose or a composite, whereas shell 14 is of plastic such as polypropylene (if it is to be retorted) or polyethylene. Shell 14 is resilently expandable, expansible, both to allow disk 16 to be snapped into it and so that shell 14 can be pressed over snap rib 22. Shell 14 can be molded by a top core removal process, with tamper evidencing band 32 in the position shown, that is, the band need not be folded upwardly. For further description of the top load closure molding process, reference may be had to Hayes U.S. Pat. No. 4,694,970, issued Sep. 22, 1987, which is incorporated herein by reference in its entirety.

In the sealing position shown, closure 13 is held downwardly on container 11 by tension in shell 14 arising from mechanical engagement of snap protrusion 28 beneath container snap rib 22. The sloping lower surface 26 of container snap rib 22 cams the shell 14 outwardly and distends it Top lip 52 of shell 14 bears downwardly on peripheral disk edge 48 and thereby holds disk 16 down on container rim 20, compressing sealant 50 in disk channel 42.

If container 11 is vacuum-packed, there is less-than-atmospheric pressure in the head space 56 above the food product 58. This relatively low pressure is exceeded and opposed by atmospheric pressure acting on the top surface of disk 16, above the container mouth 12, which adds to the mechanical hold down force of the snap. In addition or alternatively, there may be an adhesive seal between sealant 50 and the container rim 20; or disk 16 may be thermally adhered or "welded" to container 11, or it may be secured by a frictional interfit or other structure. Before closure removal is started, the tamper evidencing band 32 does not itself exert significant hold down force on shell 14, but an opening-resisting force arises when one starts to lift shell 14 and thereby brings the distal edge 34 of band 32 into engagement with the band breaking shoulder 36 of the container.

Figure 2A:
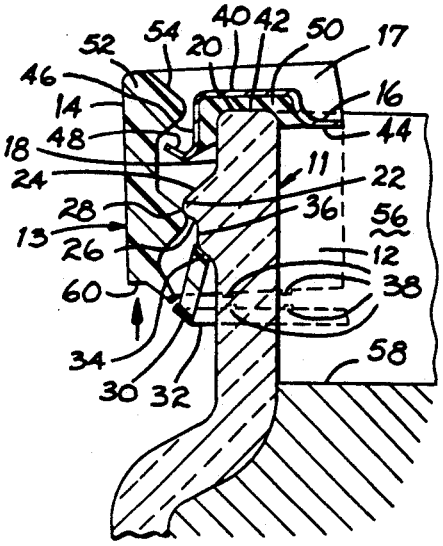

In order to open container 11, an upward force is applied either to a press-off ledge 60 on the lower end of shell 14, or alternatively to an outwardly projecting thumb tab 110 as shown in FIGS. 5–9. As upward movement of shell 14 commences, the distal edge 34 of band 32, directly under the area at which the prying force is applied, is first brought upwardly against band-breaking shoulder 36 of container 11, which resists its movement and breaks the bridges 38 which are closest to the tabs or point of force application, as depicted in FIG. 2A. The closure and container are so dimensioned that this occurs substantially before protrusion 28 has been distorted outwardly to clear snap rim 22. From the point of initial breakage, shell 14 causes bridge breakage to proceed in opposite directions around opposite sides of the band, to a point diametrically opposite that at which the prying force is applied. When bridges 38 have been broken, band 32 moves away from the shell; band 32 may separate entirely from shell 14 and drop down onto container 11, or it may remain loosely attached to shell 14 by a hinge connection. In any event, an enlarged space or gap between band 32 and shell 14 is made readily visible. This provides an indication that at least an attempt has been made to remove closure 13; the indication appears before shell 14 is unsnapped or disk 16 lifted.

Figure 2B:
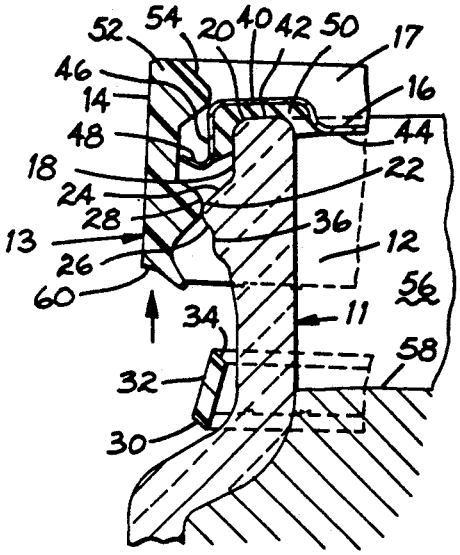

Continued upward lifting force then pries protrusion 28 over snap rib 22, again first in an area in line with the area to which the lifting force is applied, so that the mechanical hold down force of snap rib 22 is overcome in a limited circumferential area, as shown in FIG. 2B. Because vertical translation of shell 14 is restricted by snap rib 22, shell 14 must deform outwardly to clear it. The sloping lower surface 26 of snap rib 22 cams snap protrusion 28 outwardly, elastically deforming shell 14 in the area directly above the position at which opening force is applied to press-off ledge 60. From that point the prying of the rest of protrusion 28 proceeds around closure 13, to a diametrically opposite point. It is important to note that at this stage the upward movement of shell 14 still has not been applied to insert disk 16; shell 14 initially moves upward relative to disk 16 until the upper surface of snap protrusion 28 has been moved sufficiently far that it engages disk edge 48.

Figure 2C:
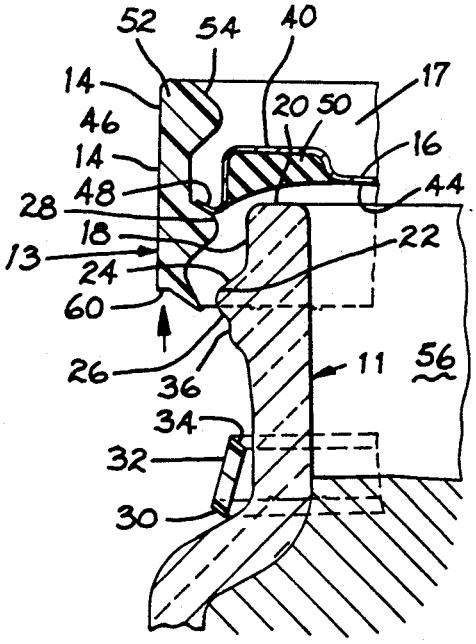

Continued shell 14 lifting movement then lifts disk 16, first in the area vertically above the point at which the force is applied to the press-off ledge 60, as illustrated in FIG. 2C. Disk 16 locally deforms upwardly in that area, breaking the seal and/or adhesion to round sealing rim 20 and permitting air to rush in to equalize the pressure inside container 11. Disk 16 then lifts around the rest of the circumference of rim 20 until it has been completely lifted from the container rim 20. The "float" between disk 16 and shell 14 separates the mechanical pry-off force from the force needed to break the seal and vacuum.

In connection with the foregoing description of closure removal, it should be noted that the three events (band breakage, shell pry-off, and disk lifting) may partially overlap in time sequence. That is, it is not required that the band 32 be entirely broken before any part of shell 14 is pried over rib 22, and so on. Sequencing of their starting points in time provides an advantage, even if the later part of one event overlaps the start of the next event.

FIG. 3 of the FIGS. shows a second form of top load closure, which differs from that shown in FIG. 2 in having a different form of tamper evidencing band 76, and further in that the snap rib 70 and the band breaking shoulder of the container are presented as a single annular rib. More specifically, the container 68 shown in FIG. 3 has a continuous peripheral rib 70 which engages both snap protrusions 72 of the shell and the upper edge 74 of the tamper evidencing band.

In the closure of FIG. 2, the tamper evidencing band 32 separates from the shell along a planar horizontal line. In contrast, the closure of FIG. 3 has a "toothed" or "notched" tamper evidencing band which more distinctly shows separation. The tamper evidencing band 76 is in the form of an annulus of smaller radius than the shell, and is connected to the shell by radially extending bridges 78 which extend across a gap between band 76 and the shell. Band 76 has a series of teeth 80 which slant inwardly and are engageable with container rib 70 as the closure is applied, then deflect outwardly to snap beneath rib 70. The shell protrusions 72 are circumferentially discontinuous, and are located in the spaces between teeth 80.

The closure of FIG. 3 is opened by exerting upward pressure on a ledge 82 at the bottom edge of the shell, or on an optional thumb tab 84. Thumb tab 84 is directly above one of protrusions 72, so the lifting force is directly applied to the protrusion to snap it over container rib 70. Edge 74 of teeth 80 first engage against the rib 70, which causes bridges 78 to break. Tamper evidencing band 76 then drops downwardly from the shell. Because of its toothed or saw edge configuration, this clearly shows that the closure has been lifted. Like the FIG. 2 closure, the closure of FIG. 3 is also molded with a top removal mold.

FIG. 5 shows a bottom load embodiment in which an insert disk 16 is fitted into a shell 92 from the bottom rather than the top. Disk 16 is retained in shell 92 between a top lip 94 which overhangs a channel 40 of disk 16 at the top, and a snap protrusion 96 on shell 92. Disk 16 is floatable over the distance identified as F in FIG. 5, between the point at which its channel 40 abuts shell top lip 94, and the point at which lower edge 98 of disk 16 abuts protrusion 96. Container 100 of the FIG. 5 embodiment has two peripheral ribs, an upper rib 102 below which shell protrusion 96 snaps and, spaced below it, a band-breaking shoulder 104 beneath which upper end 106 of tamper evidencing band 108 engages.

As in the top load embodiment, an upward force applied to thumb tab 110 first lifts the shell to break off the tamper evidencing band 108, as shown in FIG. 6. Continued force then pries snap protrusion 96 over container rib 102 to release the mechanical hold down force, as depicted in FIG. 7. By reason of the float space F, this all occurs before lifting force is applied to the lower edge 98 of disk 16. Again, a pressure force on disk 16 and any adhesive force between disk 16 and the top of the closure are not encountered until band 108 has separated and shell protrusion 96 has been released. Thereafter, shell protrusion 96 engages disk lower edge 98 and lifts disk 16 from the rim, as illustrated in FIG. 8.

FIG. 9 shows another bottom load embodiment which, instead of having two separate ribs around the container finish, has a single rib 114. Shell protrusion 118 snaps below crest 116 of rib 114, and tamper evidencing band 122 is arrested by an overhanging shoulder 120 of rib 114. The snap is easier to release because crest 116 is less acutely angulated than rib 102 of the FIG. 5 embodiment.

FIG. 9A shows the wiping or squeegeeing action of the inner surface 123 of tamper evidencing band 122 as the bottom load composite closure 150 of the present invention is placed on container 11 following the filling procedure. More particularly, as composite closure 150 is placed on container 11, the inner surface 123 of tamper evidencing band 122 wipes or squeegees the surface of incline 168 of the neck 15 of container 11 clean of residue or product which may have spilled or splashed thereon during the filling procedure, as shown in phantom in FIG. 9A. Moreover, as the inner surface 123 of tamper evidencing band 122 passes over crest 116 and the inner surface 169 of rib 114, it likewise wipes or squeegees crest 116 and surface 169 clean of any such splashed or spilled residue or product.

The embodiments described above are composite closures having separate axially floatable insert disks. Notwithstanding, it should be understood by those versed in this art that the instant invention is also useful in connection with a closure having a unitary top rather than an insert disk or a closure having a non-movable top, that is, an insert disk which does not float. FIG. 10 shows a unitary or one-piece closure embodiment having no insert disk, in which the top 130 is integral with the closure shell 131. Shell 131 includes an up-turned tamper evidencing band 132 around its periphery which may be similar to that described in connection with FIG. 2, and which engages beneath a locking rib 133 on container 134. Shell 131 has a protrusion 135 which engages beneath a locking rib 136 on container 134.

When pry-off force is applied, as shown in FIG. 11, again the closure first breaks the bridges of tamper evidencing band 132 in the area 140 vertically in line with the area to which the opening force 142 is applied, then breaks the bands 132 progressively around to the opposite side of the closure, as indicated by the arrows 144. This progressive bridge fracture reduces the effort required, in comparison to what would be required if the bridges were broken essentially simultaneously, so that pry-off force suffices even without mechanical advantage of a screw closure. The force simultaneously or subsequently pries shell protrusion 135 over container rib 136.

The embodiment of FIG. 10 is particularly useful for closures for small mouth (narrow neck) containers 134, in which the closure area is small and any pressure differential force and/or seal force is relatively small and can be overcome without need for an axially floating disk.

FIGS. 12-14 depict multifunctional snap beads 160 on necks 161 of containers 11 in combination with top or bottom load composite closures designated generally by 150 of the instant invention. FIGS. 9 and 9A are similar to FIG. 12 in that they likewise depict a multifunctional snap bead 160 of the instant invention, but in combination with a bottom load composite closure 150. The multifunctional snap beads 160 of the instant invention a.) assist press-on, pry-off closures in sliding onto the necks of containers, b.) provide for the snap beads or tamper evidencing bands of press-on, pry-off closures to wipe portions of the surfaces on the necks of containers clean as the closures are slipped onto the necks of the containers, as actually depicted and as depicted in phantom in FIG. 9A, c.) provide locks for the snap beads on the closures to permit the closures to be held on the containers, and d.) provide shoulders against which tamper evidencing bands are positioned following capping.

More particularly, and as shown in FIGS. 9, 9A and 12, in one embodiment, multifunctional snap bead 160 includes a downward and outward angulated rib 165 having an inclined exterior surface 168 which extends from sealing rim 166 to crest 116 and a downward and inward angulated rib 114 having an inclined exterior surface 169 which extends from crest 116 to shoulder 120. In this embodiment, surfaces 168 and 169 are the surfaces that the surface 123 of tamper evidencing band 122 slides over and wipes or squeegees clean during the capping process. In addition, surface 169 of rib 114 is a friction surface which holds shell protrusion 118 of composite closure 150 in place following capping. Shoulder 120 receives tamper evidencing band 122 following capping and acts to help sever tamper evidencing band free from shell 92 of composite closure 150 when composite closure 150 is being snapped on or pried-off container 11.

As a further advantage associated with this embodiment, composite closure 150 of the instant invention will automatically pop-off in those instances where there is a pressure differential which exceeds the capacity of the mechanical friction lock formed between rib 114 and shell protrusion 118 to maintain composite closure 150 on container 11. Thus, in those instances where there is an overfill, i.e., where there is less than about 6% head space remaining in the container, or the pressure inside or outside the container is too great or too little, respectively, as occasionally encountered during the filling, retorting or microwave heating processes, the composite closure 150 will pop-off container 11 resulting in self destruction of the sealed package. This unique embodiment advantageously advises for example the retorters when the vacuum seals of the sealed packages have ruptured thereby eliminating the possibility of "dirty surfaces". In this form, the composite closures 150 are preferably formed without tamper evidencing band 122, and if desired the multifunctional snap bead 160 may be formed without shoulder 120. However, when such containers are to be microwaved, the composite closures 150 may be formed with tamper evidencing band 122 and shoulder 120 to keep the closures 150 from being splashed off during the microwave heating process.

With respect to FIGS. 13 and 14, which depict an alternative embodiment of the multifunctional bead 160, multifunctional snap bead 160 is provided with rib 165, inclined exterior surface 168, crest 116 and shoulder 120, but with locking rib 136, rather than friction rib 114, for holding shell protrusion 118 on container 11 following capping. As is shown in FIGS. 13 and 14, this alternative form of the multifunctional snap bead 160 can be used in connection with bottom or top load cooperative closures. It should likewise be understood that the multifunctional snap beads of the instant invention can be used with unitary press-on, pry-off closures.

The present invention further contemplates novel tamper evidencing bands, as depicted in FIGS. 15-17. As depicted in FIGS. 15-17, a severable tamper indicating band generally designated by 170 is severed from skirt 171 along a circumferential horizontal line of weakness. Tamper indicating band 170 is in the form of an annulus and is formed integrally with skirt 171 to which it is connected along the horizontal line of weakness (not shown). The circumferential horizontal line of weakness may be a series of perforations or any other tearable configuration which will readily separate vertically from the skirt when the closure is removed. In the embodiments shown in FIGS. 15-17, the circumferential horizontal line of weakness comprises a series of spaced, vertical, frangable ribs or bridges 172 formed between the band 170 and skirt 171. A circumferential horizontal score line or partial cut around the outside of the shell 171 severs band 170 from the remainder of the closure except at these bridges 172, the bridges 172 and score line thereby defining the horizontal line of weakness. The bridges 172 act as the "weak link" along which the tamper indicating band 170 severs or tears from the skirt 171 of the upper part of the closure. As shown in FIGS. 15 and 17, tamper indicating band 170 is permanently attached to skirt 171 at one point around its circumference by a connector, bridge or hinge 173. The hinge 173 bridges the score line and is angularly wider and/or thicker than the bridges 172 so as not to rupture with the bridges 172 when the closure is removed from the container.

As further depicted in FIGS. 15 and 16, tamper indicating band 170 may further include a vertical line of weakness 174 shown in phantom (FIG. 16) which will readily split horizontally for splitting the band open (like handcuffs) 175 (FIGS. 15-16) upon removal of the closure from the container so that tamper indicating band 170 can be easily removed from the container. When tamper indicating band 170 is further provided with hinge 173 as shown in FIG. 15, tamper indicating band 170 and the closure will be simultaneously removed from the container as the closure is removed from the container. However, when tamper indicating band 170 is formed without hinge 173, the tamper indicting band can be removed from the container by the consumer only following separation of the band 170 from the closure as depicted in FIG. 16. The vertical line of weakness 174 may be formed for example by connecting the opposing ends 178 of band 170 only at a bridge 172 which breaks when the closure is removed from the container.

It should be understood that other forms of permitting tamper indicating band 170 to be removed from a container are contemplated by the instant invention. For example, a discontinuous tamper indicating band 170 may be substituted for the tamper indicating band having a vertical line of weakness so that upon severing skirt 171 from tamper indicating band 172, tamper indicating band 172 can be removed from the container via hinge 173 along with the closure as depicted in FIG. 15, or by the consumer as depicted in FIG. 16. By a discontinuous band, it is meant herein as indicated hereinbefore that the tamper evidencing band 172 is disconnected at where the vertical line of weakness would be positioned. Of course, it should be appreciated that when a vertical line of weakness or a discontinuous band is selected, a thumb tab 110 such as that illustrated in FIGS. 5-8 is preferably positioned directly over the line of weakness or where the band is discontinuous to assist in the proper breakage of the band 170 when the closure is removed from the container. The thumb tab 110 may partially or completely surround the shell of the closure to assist the consumer in prying or pulling the closure off of the container. In these embodiments, however, it is preferable to form the closure with only a partial thumb tab 110 positioned directly along the vertical line of weakness or where the band is discontinuous to automatically direct the user to that area of the band.

It should be further understood that when the containers of the instant invention require a transfer bead in the container manufacturing process, the shoulder 120, which serves to hold tamper evidencing band 122, also serve as the transfer bead in the manufacture of the container. Thus, even if the containers of the instant invention include the shoulder or transfer bead 120, it is not critical that the closures selected for use therewith be formed with tamper evidencing bands.

With respect to FIG. 17, this alternative embodiment illustrates a tamper indicating band 172 permanently affixed to skirt 171 via hinge 173. Moreover, FIG. 17 depicts tamper indicating band 172 remaining secured to the container following the severing of bridges 172 and removal of the closure from the container. In this embodiment, the closure may be repeatedly used to open and close the container while remaining secured to the container via tamper indicating band 172. Moreover, a thumb tab 110 may likewise be positioned 180° from the hinge 173 to assist in the repeated opening and closing of the container via the closure.

It should be appreciated that hinge 173 may be in a curved configuration so that it provides a torsion bar snap action permitting the closure when removed from the container to snap back automatically beyond 90° vertical so that it positions the closure out of the way of the opening of the container to permit convenient access thereto, and permitting the closure to snap down automatically to a horizontal press-on position when reclosing is desired so that the closure can be easily pressed back on the container to reseal same. Exemplary of a material that can be used to form hinge 173 for this purpose is polypropylene. Other suitable materials that can be used to form hinge 173 to accomplish this purpose are known to those versed in this art.

The present invention further contemplates a novel press-on, pry-off composite closure provided with a valve system to substantially prevent the introduction of contaminants into a vacuum-packed container upon initially removing the closure from the container. More particularly, and as depicted in FIGS. 18 and 19, a novel composite closure generally designated by 150 is provided with a gutter system generally designated as 181 formed by the disk 182 and the inner side surface 183 of shell 92. As can be seen in FIGS. 18 and 19, gutter system 181 is uniquely designed to substantially catch contaminants which may be sucked into the container 11 which originate from or travel over the exterior portion of disk 182 or from above the closure 150. As shown in FIG. 18, the composite closure 150 is in a sealed configuration on container 11. In FIG. 19, however, the process to remove closure 150 from container 11 has begun whereby shell protrusion 118 of shell 92 has been raised above crest 116 to make contact with gutter 187 to begin lifting disk 182 via shell protrusion 118. As shown in FIG. 18 and 19, disk 182 is formed at the peripheral outer edge with gutter 187 so that it remains in substantial contact with shell inner side surface 183 to collect contaminants when the vacuum formed between container rim 166 and disk 18 is initially broken.

If desired, a second valve system may be employed when the containers 11 are formed with the multifunctional snap bead 160 as described in FIGS. 9, and 12-14. In this embodiment, as shown in FIGS. 18 and 19, the shell protrusion 118 of shell 92 is designed to uniquely remain in contact with the inclined surface 168 of downward and outward angulated rib 165 for a distance once it is positioned over the crest 116 of container 11 during removal of the closure 150 from the container 11. As earlier discussed, during this time frame, the shell protrusion 118 uniquely acts to substantially prevent contaminants from entering container 11 upon initially opening the container wherein the contaminants may originate and travel along the lower neck portion 188 of container 11 or from underneath the closure 150. It should be understood that these valves systems may be used individually or in combination with one another and may be formed with top or bottom load press-on, pry-off composite closures. When a bottom load composite closure is selected, the lid may likewise be formed with a gutter system 181 similar to that depicted in FIGS. 18 and 19.

In addition to providing a composite closure with a tamper indicating band that wipes or squeegee cleans the surface 168 of downward and outward angulated rib 165 and the surface 169 of downward and inward angulated rib 114, as shown in FIGS. 9, 12-14 and 18-19, a second wipe or squeegee device is contemplated by the instant invention, as depicted in FIG. 20. In FIG. 20, shell protrusion 118 is formed with, for example, a cold flow thermoplastic material, such as polypropylene, which will flex and squeegee during the capping process, but once stressed following capping, it will take on the permanent snap bead deformation 191, as depicted in FIG. 20. Thus, as composite closure generally depicted by 150 is capped on container 11, shell protrusion 118 shown in phantom wipes or squeegees clean the surface 168 of rib 165 and crests 116 until it passes over crest 116 and permanently deforms into the snap bead deformation 191, as depicted in FIG. 20. In the snap bead deformation 191 as depicted in FIG. 20, the formed snap bead 191 maintains a mechanical friction against rib 114 which holds composite closure 150 on container 11, as illustrated in FIG. 20.

While the composite closures of the present invention are provided with bands which "wipe" or "squeegee" against the upper surface of snap ribs of the neck of containers, a preferred form of tamper evidencing band is that described in U.S. Pat. No. 4,694,970 issued Sep. 27, 1987, which reference may be had and which is incorporated herein by reference. In addition to cleaning "dirty surfaces" via the wipe or squeegee bands as described herein, it may be desirable to provide the closures of the instant invention with water washing slots as described in the U.S. patent application, Ser. No. 566,239, filed Aug. 15, 1990, and with thermally responsive water washing slots such as described in the U.S. Pat. application, Ser. No. 07/535,400, filed Jun. 8, 1990, which are incorporated herein by reference in their entireties. When the composite closures of the instant invention are formulated with water washing slots, it is preferable for the shells to be formed of a material, such as polypropylene, which can thermally expand so that the wash water can penetrate past the gutter systems and the shell snap beads to drain out of the bottom of the closures. Still further, while the snap beads of the shells of the composite closures of the instant invention are used herein, for example, to lift the disks when opening the containers, it should be understood that the instant invention further contemplates shells having beads positioned between the snap beads and top lids of the shells for lifting the disks when removing the composite closures from the containers.

With respect to the microwavable snap-on, pry-off closures and packages contemplated by the instant invention, one preferred embodiment will be described with particular reference to FIGS. 21–23 and 26. These FIGS. 21–23 and 26 illustrate a package 200 having a snap-on, pry-off closure 201 for sealing a glass or plastic or similar container 202, in the form of, for example, an hour glass or Boston bean shaped pot, as depicted in FIG. 21 at 202. The container 202 includes a radially outwardly projecting bead 203 at the container rim 204. The snap-on, pry-off closure 201 in accordance with the present invention is applied to and is placed in sealing enagement with the container 202 by being pressed downwardly onto the container 202. The snap-on closure 201 is removed by being pryed off by a user. This can be accomplished simply by placing a thumb under thumb tab 205 and, while holding the container 202, pushing upwardly with the thumb to pry the closure 201 loose from the container 202.

A preferred embodiment of the closure cap 201 comprises a circular metal cover 206 contained in an outer plastic ring 207. The metal cover 206 preferably includes a depressed central stacking panel 208, a vacuum flip-panel button if vacuum packed (not shown), and an outer, downwardly facing gasket receiving channel 209. The channel 209 is defined by the sloping wall 210 of the stacking panel 208 and a depending outer metal skirt or wall portion 211 on the metal cover 206. A preferred form of a sealing gasket 212 is a flowed-in plastisol sealing gasket 212 positioned in the channel 209 between sloping wall 210 and wall portion 211. The gasket 212 is positioned to form a hermetic or vacuum seal with the upper rounded rim portion 204 of the container 202 in the manner illustrated in FIG. 21. The metal cover 206 includes an inner lacquer or other protective coating 216 which is inert with respect to the products or foods to be packaged in the container.

The plastic ring 207 is preferably molded as a unitary piece with its several elements being shaped in the manner and for the purpose described below. The ring 207 is preferably molded of a plastic which provides dimensional stability together with a smooth surface appearance and a high resistance to impact or other possibly damaging treatment. Suitable plastics for this purpose include polyethylene, rigid polypropylene, copolymers such as polypropylene, or similar impact resistant resins. Examples of a copolymer plastic, such as polypropylene, or a rigid polypropylene include product 5B04Z, Huntsman Polypropylene Company, and product SB787, Himont, Inc.

A preferred shaping for the plastic ring 207 is illustrated in FIGS. 21–23 and 26, and as especially illustrated in FIG. 26. The ring 207 includes a plastic depending skirt portion 217 generally parallel to the container axis which is connected by a corner portion 218 to an annular radially inwardly extending partial cover 219. The upper portion of the plastic skirt 217 together with the corner 218 and the partial cover 219 cooperate together with a container engaging bead 220 to form an inwardly directed channel 221 for receiving and for engaging the outer portion of the metal cover 206 including the metal skirt or wall portion 211. The channel 221 has a width corresponding generally to the height of the skirt portion 211 on the metal cover 206, so that the metal cover 206 may be firmly or loosely mounted and retained in the plastic ring 207.

The plastic skirt 217 and the cover portion 219 of the plastic ring 207 are seen to be relatively thick to provide a firm retaining ring. The cover portion 219 preferably extends inwardly to the outer end of the stacking panel wall 208 and slightly inwardly of the container rim 204. The plastic skirt 217 may be extended downwardly for a selected length, as illustrated in FIG. 23 or 26, so that when it is loosely positioned on the container 202, it will not easily fall off or be easily knocked off. While the plastic skirt 217 illustrated in FIG. 26 is extended downwardly for a selective length, it should be appreciated that the plastic skirt 217 depicted in FIG. 26 may be constructed without the extended selective length.

Thus, when the closure 201 is snapped into position with its plastic outer skirt 217 engaged by the above-described channel 221, a microwavable composite closure results which may be handled as a unit during the filling, sealing, retorting, shipping and microwaving operations typical for the composite package usage.

FIGS. 22 and 26, and especially FIG. 26, illustrate a preferred cross section shape for the bead 220 which is provided on a preferred embodiment of the composite closure cap 201. In cross-section, the bead 220 has a lower guide portion 222 forming an acute angle with the vertical or the container axis for facilitating the downward press-on application of the composite closure caps 201 to the containers 202. As being pressed on, the lower portion 222 of the bead 220 communicates with a container bead 203 engaging surface 223 which has a slight angle with the horizontal on the plane of the container rim 204 to assure a firm engagement with the inwardly slanted surface 224 of the container bead 203. It is believed that this slight angle, inter alia, allows the gentle venting or loose pressure-/or pry-up in accordance with the present invention.

During the filling operation, it has been discovered that when a sufficient head space (not shown) remains between the inside surface 225 of the metal cover 206 of the composite closure 201 and the food product (not shown) in the container 202 on the order of about 8–16% or more as defined by package volume, it permits the food to tumble around inside the package during the retorting process, thereby significantly reducing the time required to cook the food product. As a result of the reduced cooking time, the quality of the retorted food product is dramatically improved from the standpoint of flavor, color and texture, and amazingly approaches that of frozen foods. For example, it has been surprisingly discovered that retort time for a single serving composite package 200 of the present invention having about 8–16% or more head space or on the average of about 12% headspace can be remarkably reduced by approximately 20 minutes. This not only reduces labor time and cost, but a significant savings in energy is realized. Moreover, by providing an effective increase in head space, it uniquely permits steam and pressure to gradually accumulate during the microwaving process, so that the closure 201 will not violently blow off the container 202. Rather, the head space uniquely permits the closure 201 to be gently pressured-off the container 202 as the steam and pressure gradually builds during the cooking process, as illustrated in FIG. 23.

It should therefore now be apparent to those versed in this art that when the composite packages of the instant invention include an effective increase in head space following the filling and sealing operations, the time required to retort vacuum-packed food packages to precook and sterilize the food products contained within is significantly reduced, and the quality of the retorted food product is dramatically improved, so that it now approaches that of frozen foods. Moreover, it should be appreciated by those skilled in this art that the increase in head space uniquely and automatically allows for a more gradual build up of steam and pressure during cooking in, for example, microwaves, so that the composite closures are gently pressured loose, but not off the containers. And, because the composite closures generally remain on the containers, this provides the added benefit of guarding against food splash during the microwave cooking process It should be further appreciated that, if the skirt portion of the plastic rings is too short, so that the closures will not remain on the containers once pryed or pressured loose, they can be lengthened to any suitable length, as depicted in FIGS. 24–25, to accomplish this objective.

FIGS. 24–25 illustrate another form of a container engaging ring 230 in accordance with the present invention. The container engaging ring 230, which is referred to as a flex ring, is similar to ring 207 except that it affords greater venting capability during the microwave cooking process. More particularly, the container engaging ring 230, as illustrated in FIGS. 24–25, is molded as a unitary piece from a copolymer plastic, such as polypropylene, or a rigid polypropylene available from product 5B04Z, Huntsman Polypropylene Company, and product SB787, Himont, Inc., which has the capability to uniquely relax as it heats up, so that ring 230 will act as a flexible diaphragm to permit steam and pressure to readily leak from the container 231 during the microwave cooking process once the vacuum seal is broken. While the ring 230 shown in FIGS. 24–25 is similar to the ring 207 shown in FIGS. 21–23, the inwardly extending partial cover portion 239 extends for a longer distance. As shown in FIGS. 24–25, the inwardly extending partial cover portion 239 extends along the entire sloping wall 232 and onto the depressed central stacking panel 233. As shown in FIG. 25, as the snap-on, pry-off composite closure 234 is heated during the microwave cooking process, steam and pressure gradually builds within the container 231 due to the head space, so that the snap-on, pry-off composite closure 234 is first vented or gently pressured loose above the mechanical bead 240 which breaks the vacuum seal formed between the dust cover 235 and the container rim 236, and to permit both the steam and pressure to escape.

As shown in FIG. 25, as the steam and pressure accumulates internally and the vacuum seal is first vented and then broken, the snap-on, pry-off composite closure 234 is pressured loose above the container bead 237. Because of the increase in temperature, the plastic ring 230 relaxes as it heats up, permitting the steam and pressure to pass downwardly over the container bead 237 and upwardly over the metal dust cover 235, as depicted in FIG. 25. Moreover, since the depending skirt 238 is an added length, as shown in FIGS. 24–25, the snap-on, pry-off composite closure 234 will remain loosely on the container rim 236 during the entire microwave cooking process. This permits the snap-on, pry-off composite closure 234 to act as a splash guard, thereby preventing any food product from splattering out of the container 231 during the microwave cooking process.

It should now be readily apparent to those of skill in this art that while the retorting and microwaving features of the present invention have been discussed herein in connection with the snap-on, pry-off composite closures and packages illustrated in FIGS. 21–25, such features can also be realized with the snap-on, pry-off closures and packages described elsewhere herein throughout. Moreover, the plastic rings disclosed herein throughout may likewise be formed as a unitary construction with rigid polypropylene, polypropylene copolymers or the like to achieve the same relaxing benefits realized with the plastic rings illustrated in FIGS. 24–25. In addition, while it is preferable to utilize metal dust covers with the plastic rings to form the snap-on, pry-off composite closures of the instant invention, it should nevertheless be understood that other non-metallic covers may be selected, such as plastic or the like. Still further, in producing the snap-on, pry-off composite closures, it should be understood that the dust covers may be integrally connected to the plastic rings, as illustrated in FIGS. 21–23, or be "free floating" discs or dust covers as shown in FIGS. 24–25. Of course, in order to realize the maximum benefits of the flex ring, it is preferable to utilize a "free floating" or loose dust cover or lid therewith.

It should be further understood that the dimensional depth of the head space between the dust covers or lids and food product in accordance with the present invention may vary depending upon the size of the container and its opening, the degree of vacuum, e.g., high or low, (if present), and the food product to be retorted or microwaved. Relative to the type of food product and head space, it's been found that foods high in fat are more volatile when heated as are foods or food mixtures high in entrapped air, like beans, etc. It has also been discovered that these volatile types of foods are believed to be more apt to blow closures with volcanic eruptions when the head spaces are restricted as utilized heretofore. Thus, it has been found that a ⅜ inch or about 12% head space for a 9 oz. container having a 77 mm size opening and a shape similar to the container illustrated in FIG. 21 and which is filled with a product, such as beef stew, is adequate. It should be appreciated, however, that when such a package is heated on high in an initially cool 750 watt microwave oven for about 90 seconds, the higher the negative vacuum present in the sealed package, the longer it takes to heat and build a positive pressure that can then force the package to vent.

In addition, it should be appreciated that, while the benefits relative to head space, retorting and microwaving have been described in connection with bottom load snap-on, pry-off composite closures, the present invention also contemplates the use of unitary snap-on, pry-off, twist-on, screw-on, or top-loaded combination closures to realize such advantages. Nevertheless, it has been discovered that some press-on, pry-off closures will vent with as little as one lb. of internal positive pressure or approximately 1/10 that is required to vent the twist or screw-on type closures. Moreover, it should be appreciated that food packages sealed with snap-on, pry-off closures without vacuum may also realize the benefits associated with packages having head spaces as taught herein when cooking such packages in microwaves. It should be understood however that, irrespective of whether the packages are sealed under vacuum, it may be preferable to rupture the seals of the food packages before mircowaving, to minimize the potential explosiveness that develops when the sealed packages are microwaved. It should further be appreciated that the snap-on, pry-off closures of the present invention may be formed with frangible tamper evident bands as described, for example, herein throughout to prevent the snap-on, pry-off closures from blowing off the containers during the retort or microwave cooking processes. Still further, the containers of the present invention may include a wrap-around foam label or the like, as shown in phantom in FIG. 21, for permitting users to handle the containers following the microwave cooking process without getting burned.

In accordance with the present invention, press-on, pry-off closures with a combination of parts, e.g., a band combined with a floating disc, and movements allows for an adhesive sealant to be utilized to form and maintain a long-term hermetic seal without vacuum or compression. More particularly, the adhesive sealant is easily pried up after the mechanical snap between the combo closure band and its respective container bead is first unsealed, particularly if the bond is also teathered to the container by a frangible tamper evident ring that is to be broken simultaneously. It should be appreciated that this mechanical snap is the prime engine to effect a reseal, and the adhesive is the prime engine to effect and maintain the initial, hermetic seal. To accomplish this aspect of the instant invention, the gasket seal formed in the combo closure normally with plastisol is replaced with a tacky adhesive gasket, such as a hot melt adhesive. The tacky hot melt adhesive should have the ability to bond the combo closure to the container rim in such a manner that an effective hermetic seal is perfected which approximately duplicates the shelf-life of a vacuum seal. It is believed that a hot, soft adhesive seal would make the best exact, embossed plug seal impression of a potentially imperfect container seal surface, and increase the surface area of the interface, both of which are useful to achieve a more perfect seal, but yet not be under as much permanent compression as achieved by a vacuum or threads, lugs or crimp-on, etc. mechanical leverage.

The float between the two parts of the combo closure allows these at least two forces to be overcome separately as an integral or one-piece, etc., whereas a closure could not be easily pried-off by hand when these two, or more forces are combined. Also, the combination of this potentially embossed, plug seal interface that has some residual tack left from its initial high-tack adhesive seal and the holding power of the mechanical snap beads improves the art of effective, yet simple, reseals.

Relative to microwaving as previously described, this combo float is not necessary as heating containers without a vacuum in the package would reheat and allow a hot-melt adhesive, for instance, to vent and be easily removed because the band also gets hot and expands enough with increased flexibility to snap easily over its respective container bead. However, in some potential, non-vacuum microwave applications it may be preferred to pre-open a resealable package at room temperature or below. Therefore, the combo float is useful and novel even though it would still microwave safely, which is important if the opening instructions are ignored or over-looked by the consumer.

The present invention, may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced herein.

Having described my invention, I claim:

1. A vacuum-sealed package containing a food product for retorting in a shorter period of time, said food product having improved flavor, color and texture following the retort process in said package, said package comprising:

a container filled with said food product, said container being vacuum sealed with a closure and having a rim and a radially outwardly projecting container bead adjacent said rim;

said closure being a snap-on, pry-off closure having a molded plastic ring with an annular cover portion coupled to a downwardly dependent skirt portion, said skirt portion having inwardly projecting container bead-engaging means snapped over said container bead, an inwardly facing channel on the inner side of said skirt portion, a circular cap cover positioned within said ring and having an outer edge received within said channel, said outer edge spaced above said bead-engaging means, a sealing gasket on the underside of said cap cover and engaging said container rim, a head space in said container defined between said closure and said food product, said head space being at least about 12% of the internal volume of said container as sealed and being an effective amount of space for reducing the amount of time required to effectively retort said food product in said vacuum-sealed package and for improving the flavor, color and texture of said food product following the retort process, as compared to a similar vacuum-packed package containing a similar food product but with a head space occupying from about 0 to about 6% of the total internal space defined by a similar closure and a similar container and as compared to the flavor, color and texture of a similar food product retorted in the similar vacuum-sealed package, said closure being removable by prying it upwardly to outwardly deform said bead-engaging means so that it passes over said container head, then bringing said bead-engaging means upwardly into engagement with said outer edge of said cap cover to lift said cap cover from said rim.

2. A vacuum-sealed package containing a food product for retorting in a shorter period of time, said food product having improved flavor, color and texture following the retort process in said package, said package comprising:

a snap-on, pry-off closure;

a container filled with said food product, said container being vacuum sealed with said closure; said container having a rim and a radially outwardly projecting container bead adjacent its rim;

a head space in said container defined between said closure and said food product, said head space being an effective amount of space for reducing the amount of time required to effectively retort said food product in said vacuum-sealed package and for improving the flavor, color and texture of said food product following the retort process, as compared to a similar vacuum-packed package containing a similar food product but with a head space occupying from about 0 to about 6% of the total internal space defined by a similar closure and a similar container and as compared to the flavor, color and texture of a similar food product retorted in a similar vacuum-sealed package;

said closure comprising a molded plastic ring having an annular cover portion coupled to a downwardly dependent skirt portion, an inwardly projecting container engaging means on said skirt portion for engaging said container bead adjacent the rim of said container, said engaging means having a generally horizontal container bead engaging portion at its top and a guide portion therebelow forming an acute angle with the vertical, an inwardly facing channel on the inner side of said snap-on, pry-off closure defined by said cover portion, said skirt portion and said container engaging means, a circular cap cover positioned within said ring having an outer depending skirt received within said channel, said cap cover having a lower edge positioned above said bead engaging portion of said container engaging means and having an outer annular top portion in engagement with the underside of said cover portion of said ring, the lower portion of said skirt being spaced from said container, and a sealing gasket on the underside of said cap cover for engaging the container rim.

3. A vacuum-sealed package as recited in claim 2, said corner portion of said ring including an upwardly extending circular stacking flange.

4. A vacuum-sealed package as recited in claim 2, said container engaging means comprising a circular bead.

5. A vacuum-sealed package as recited in claim 2, said container engaging means comprising a plurality of arcuate lugs.

6. A vacuum-sealed package as recited in claim 2, said ring being a plastic ring and said skirt portion including a tamper-evident band removably connected at the bottom edge thereof.

7. A vacuum-sealed package as recited in claim 2, said container being a glass container and said circular cap cover being a circular metal cap cover.

8. A vacuum-sealed package as recited in claim 2, said snap-on, pry-off closure being a unitary metal snap-on, pry-off closure.

9. A vacuum-sealed package as recited in claim 2, said skirt portion having tab means extending outwardly from the outer side thereof for permitting force to be applied thereto in an upwardly direction to pry such closure off of said container.

10. A vacuum-sealed package as recited in claim 2, said container rim being generally rounded convex in cross-section.

11. A vacuum-sealed package containing a food product for retorting in a shorter period of time, said food product having improved flavor, color and texture following the retort process in said package, said package comprising:

a snap-on, pry-off closure;

a container filled with said food product; said container having a rim and a radially outwardly projecting container bead adjacent said rim, said rim being generally rounded convex in cross-section, said container being vacuum sealed with said closure; and a head space in said container defined between said closure and said food product, said head space being an effective amount of space for reducing the amount of time required to effectively retort said food product in said vacuum-sealed package and for improving the flavor, color and texture of said food product following the retort process, as compared to a similar vacuum-packed package containing a similar food product but with a head space occupying from about 0 to about 6% of the total internal space defined by a similar closure and a similar container and as compared to the flavor, color and texture of a similar food product retorted in a similar vacuum-sealed package;

said snap-on, pry-off closure comprising a molded plastic ring having an annular cover portion and a downwardly depending skirt portion, said cover portion and said skirt portion being relatively rigid and both being generally rectangular in cross-section;

said cover portion and said skirt portion being coupled together by a corner portion, radially inwardly projecting holding means on the inner surface of said plastic ring for engaging a lower portion of the cap engaging bead on the container, said holding means having a rounded convex cross-section including an upper container bead-engaging surface extending radially inwardly and downwardly from said inner ring surface at a slight angle to the horizontal and then curving downwardly and outwardly from its radially innermost portion at an acute angle to the vertical forming a lower guide portion, said cover portion, said corner portion, said skirt portion and said container engaging means on said plastic ring cooperating to form an inwardly facing channel, a circular metal cap cover positioned within said plastic ring having an outer depending skirt received within said channel with its lower skirt edge positioned above the radially outermost portion of the bead engaging surface of said holding means and having an outer annular top portion in engagement with the underside of the cover portion of said plastic ring, the lower portion of said skirt portion being spaced from said container, and a sealing gasket on the underside of said metal cap cover for engaging the container rim.

12. A vacuum-sealed package as recited in claim 11, said skirt portion having tab means extending outwardly from the outer side thereof for permitting force to be applied thereto in an upwardly direction to pry said closure off of said container.

13. A hermetically sealed package containing a food product for heating in a microwave, said package comprising a snap-on, pry-off closure, a container filled with said food product, said container being hermetically sealed with said snap-on, pry-off closure, said container having a rim and a radially outwardly projecting container bead adjacent said rim, and a head space in said container defined between said snap-on, pry-off closure and said food product, said head space occupying between about 8% and 16% of the total space defined by said closure and said container when said container is sealed with said closure, said head space being an effective amount of space for permitting such snap-on, pry-off closure to be gently pressured loose from said container due to the gradual accumulation of steam vapor and pressure during the microwave heating process, as compared to a similar hermetically sealed package containing the same food product but with a head space occupying from about 0% to about 6% of the total interior space defined by the closure and the container when the container is sealed with the closure, whereby the closure of the similar package will be forcefully popped off the container during the microwave cooking process, said closure comprising a molded plastic ring having an annular cover portion coupled to a downwardly dependent skirt portion, an inwardly projecting container engaging means on said skirt portion for engaging said container bead adjacent said rim of said container, said engaging means having a generally horizontal container bead engaging portion at its top and a guide portion there below forming an acute angle with the vertical, an inwardly facing channel on the inner side of such snap-on, pry-off closure defined by said cover portion, said skirt portion and said container engaging means, a circular cap cover positioned within said ring having an outer depending skirt received within said channel, said cap cover having a lower edge positioned above said bead engaging means and having an outer annular top portion in engagement with the under side of said cover portion of said ring, the lower portion of said skirt being spaced from said container, and a sealing gasket on the under side of said cap cover for engaging the container rim.

14. A hermetically sealed package as recited in claim 13, said cover portion and skirt portion being coupled by a corner portion, said corner portion of said ring including an upwardly extending circular stacking flange.

15. A hermetically sealed package as recited in claim 13, said container engaging means comprising a circular bead.

16. A vacuum-sealed package as recited in claim 13, said container engaging means comprising a plurality of arcuate lugs.

17. A hermetically sealed package as recited in claim 13, said skirt portion including a tamper evident band removably connected at the bottom edge thereof.

18. A hermetically sealed package as recited in claim 13, said container being a glass container and said circular cap cover being a circular metal cap cover.

19. A hermetically sealed package as recited in claim 13, said snap-on, pry-off closure being a unitary metal snap-on, pry-off closure.

20. A hermetically sealed package as recited in claim 13, said skirt portion having tab means extended outwardly from the outer side thereof for permitting force to be applied thereto in an upwardly direction to pry off said snap-on, pry-off closure off said container.

21. A hermetically sealed package containing a food product for heating in a microwave, said package comprising a snap-on, pry-off closure, a container filled with said food product, said container being hermetically sealed with said snap-on, pry-off closure, said container having a rim which is generally rounded convex in cross section and a radially outwardly projecting container bead adjacent said rim, and a head space in said container defined between said snap-on, pry-off closure and said food product, said head space occupying between about 8% and about 16% of the total space defined by said closure and said container when said container is sealed with said closure, said head space being an effective amount of space for permitting such snap-on, pry-off closure to be gently pressured loose from said container due to the gradual accumulation of steam vapor and pressure during the microwave heating process, as compared to a similar hermetically sealed package containing the same food product but with a head space occupying from about 0% to about 6% of the total interior space defined by the snap-on, pry-off closure and the container when the container is sealed with the snap-on, pry-off closure whereby the snap-on, pry-off closure of the similar package will be forcefully popped off the container during the microwave cooking process, said closure comprising a molded plastic ring having an annular cover portion and a downwardly depending skirt portion, said cover portion and said skirt portion being relatively rigid and both being generally rectangular in cross-section, said cover portion and said skirt portion being coupled together by a corner portion, radially inwardly projecting holding means on the inner surface of said plastic ring for engaging a lower portion of the cap engaging bead on the container, said holding means having a rounded convex cross-section including an upper container bead engaging surface extending radially inwardly and downwardly from said inner ring surface at a slight angle to the horizontal and then curving downwardly and outwardly from its radially innermost portion at an acute angle to the vertical forming a lower guide portion, said cover portion, said corner portion, said skirt portion and said container engaging means on said plastic ring cooperating to form an inwardly facing channel, a circular metal cap cover positioned within said plastic ring having an outer depending skirt received within said channel with the lower skirt edge positioned above the radially outermost portion of the bead engaging surface of said holding means and having an outer annular top portion in engagement with the under side of the cover portion of said plastic ring, the lower portion of said skirt portion positioned to be spaced from container, and a sealing gasket on the under side of said metal cap cover for engaging the container rim.

22. A hermetically sealed package as recited in claim 21, said skirt portion having tab means extending outwardly from the outer side thereof for permitting force to be applied thereto in an upwardly direction to pry said snap-on, pry-off closure off of said container.

23. A hermetically sealed package as recited inc claim 21, said skirt portion including a tamper evident band removably connected at the bottom edge thereof.

24. A hermetically sealed package as recited in claim 13, said hermetically sealed package being sealed under vacuum.

25. A hermetically sealed package as recited in claim 21, said package being sealed under vacuum.

* * * * *